US006682175B2

(12) United States Patent
Otsuka et al.

(10) Patent No.: US 6,682,175 B2
(45) Date of Patent: Jan. 27, 2004

(54) INK JET RECORDING HEAD AND INK JET RECORDING APPARATUS

(75) Inventors: Yasuhiro Otsuka, Kanagawa (JP); Kazuhiko Hayashi, Tokyo (JP); Toshinori Ishiyama, Kanagawa (JP); Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 8 days.

(21) Appl. No.: 10/230,363

(22) Filed: Aug. 29, 2002

(65) Prior Publication Data

US 2003/0063171 A1 Apr. 3, 2003

(30) Foreign Application Priority Data

Aug. 31, 2001 (JP) ..... P. 2001-264452

(51) Int. Cl.[7] ..... B41J 2/04
(52) U.S. Cl. ..... 347/54
(58) Field of Search ..... 347/54, 68, 70, 347/72, 71, 50, 40, 20, 44, 47, 27, 63; 399/261; 361/700; 310/328–300; 29/890.1

(56) References Cited

U.S. PATENT DOCUMENTS 5,757,400 A 5/1998 Hoisington

FOREIGN PATENT DOCUMENTS

| | | |
|---|---|---|
| JP | 56-75863 | 6/1981 |
| JP | 59-26269 | 2/1984 |
| JP | 59-42964 | 3/1984 |
| JP | 59-98860 | 6/1984 |
| JP | 10-508808 | 9/1988 |
| JP | 1-308644 | 12/1989 |
| JP | 8-58089 | 3/1996 |
| JP | 9-141864 | 6/1997 |
| JP | 9-156095 | 6/1997 |
| JP | 9-314836 | 12/1997 |
| JP | 2806386 B2 | 7/1998 |
| JP | 2000-33713 | 2/2000 |

*Primary Examiner*—Raquel Yvette Gordon
(74) *Attorney, Agent, or Firm*—Morgan, Lewis & Bockius LLP

(57) ABSTRACT

In an ink jet recording head, an ink pool has a main flow path communicating with an ink supply port and a plurality of branch flow paths branching from the main flow path. Each ejector has a pressure chamber, a pressure generating unit and a nozzle. The pressure chamber communicates with the corresponding one of the branch flow paths. The pressure generating unit generates a pressure wave in ink charged into the pressure chamber. The nozzle ejects the ink from the pressure chamber compressed by the pressure wave. At least one wall surface forming each of the branch flow paths is formed of a damper member elastically deformable in accordance with the change of pressure in the branch flow path.

11 Claims, 17 Drawing Sheets

INK JET RECORDING HEAD AND INK JET RECORDING APPARATUS

The present disclosure relates to the subject matter contained in Japanese Patent Application No. 2001-264452 filed on Aug. 31, 2001, which are incorporated herein by reference in its entirety.

BACKGROUND OF THE INVENTION

1. Field of the Invention

The present invention relates to an ink jet recording head and an ink jet recording apparatus, and particularly relates to an ink jet recording head for ejecting ink droplets from a plurality of ejectors arrayed in a matrix, and an ink jet recording apparatus mounted with the ink jet recording is head.

2. Description of the Related Art

Non-impact recording systems have features of high speed, high image quality, low noise, and so on, and prevail in current printers. Of them, ink jet printers which fly ink droplets from a plurality of nozzles so as to perform printing of characters, drawings, pictures, and the like, on recording paper, are in widespread use because the ink jet printers have features in small size, low cost and capability of performing photorealistic printing.

An ink jet recording head is designed as follows. That is, while the head is moved in the main-scanning direction, ink droplets are ejected selectively from a plurality of nozzles, for example, 24–300 nozzles per color, in accordance with an electric signal based on print data. Thus, the ink droplets are made to adhere to the surface of a medium to be recorded on, such as recording paper. Further, in combination of the operation to feed the recording medium in the sub-scanning direction perpendicular to the main-scanning direction, the recording head can print characters or drawings on the medium to be recorded on.

In the ink jet recording head configured thus, ink is stored in an ink pool provided to be shared by the plurality of nozzles. The ink in this ink pool is introduced into pressure chambers via narrow inlets provided in the nozzles respectively. Further, in each of the pressure chambers, pressure exerting on the ink is generated by a pressure generating unit such as a piezoelectric element actuated in response to the electric signal. Thus, an ink droplet is ejected from the nozzle. The ink droplet ejecting mechanism constituted by the nozzle, the pressure chamber, the inlet and the pressure generating unit will be referred to as "ejector".

An example of an ink jet recording head configured thus is disclosed in JP-A-8-58089. FIGS. 16 and 17 are a sectional view and a plan view showing the ink jet recording head disclosed in the same publication respectively.

As shown in FIGS. 16 and 17, the ink jet recording head has a nozzle formation plate 61, an ink pool plate 61, a diaphragm formation plate 63 having ink supply diaphragms 63*a* (corresponding to the inlets), a sealing plate 64, a pressure chamber formation plate 65 and a pressure plate 66. These plates 61 to 66 are laminated in the order named. Each pressure generating unit is constituted by the pressure plate 66 and a piezoelectric element 67. A pressure wave (acoustic wave) is generated for the ink in a pressure chamber 71 by applying a voltage control signal between an upper electrode 68*a* and a lower electrode 68*b*. By the plates 61 to 66, an ink flow path is formed to reach-each nozzle 73 from the ink pool 69 through the ink supply diaphragm 63*a*, a communication-hole 70, the pressure chamber 71 and an ink communication hole 72.

In such an ink jet recording head, each ejector has the pressure generating unit constituted by the pressure plate 66 and the piezoelectric element 67, the nozzle 73, the pressure chamber 71 and the ink supply diagram 63*a*. Such ejectors are arrayed in a straight line as shown in FIG. 17, so as to form an ejector array 74. The ink jet recording head having ejectors arrayed in a straight line will be referred to as "linear array head".

Such a linear array head using piezoelectric elements as pressure generating units had a problem in realization of high-density arrangement of ejectors due to characteristic limits of the pressure generating units and restrictions on the manufacturing technology. In order to align the ejectors in high density in the linear array head, it is necessary to reduce the pressure chamber width. It is therefore necessary to arrange the ink jet recording head out of elongated ejectors having a large aspect ratio.

However, when the pressure chamber width is reduced to achieve the high-density arrangement of the ejectors, the width of a movable area of the pressure plate is also reduced so that the bending rigidity of the pressure plate increases. Thus, a sufficient deformation amount of the pressure plate cannot be obtained. As a result, there arises a problem that it becomes difficult to eject a desired quantity of ink droplets. In addition, the pressure chambers can be formed by etching, machining, resin molding, or the like, but there is also a limit in the reduction of the pressure chamber width due to the accuracy limit of machining.

Thus, in the linear array head using pressure generating units each constituted by a pressure plate and a piezoelectric element, there was a limit in high-density arrangement, substantially about 120–180 pieces/inch, due to the performance limit of the pressure generating units and the restrictions on the manufacturing technology. In the linear array head, ejectors can be indeed arrayed zigzag for doubling nozzle density. In that case, however, there arises a new problem that the head size increases while the head cost doubles.

As an ink jet recording head to solve the foregoing problems, there is known a recording head in which a large number of ejectors each having a pressure chamber with an aspect ratio close to 1 are arrayed in a matrix so as to place nozzles in high density. Recording heads configured thus are disclosed in Japanese Patent No. 2806386, JP-A-9-156095 and Japanese Translations of PCT publication No.10-508808, respectively.

FIGS. 18 and 19 show the main portion configuration of the ink jet recording head disclosed in Japanese Patent No. 2806386. This recording head will be referred to below as "matrix array head" because nozzles 75 are arrayed in a matrix.

The matrix array head has a nozzle plate 82, a distribution plate 83, a cavity plate 84 and a pressure plate 85. The plates 82 to 85 are laminated in the order named. The nozzle plate 82 has the nozzles 75. The distribution plate 83 has ink supply grooves 79 and ink passageways 77. The cavity plate 84 has pressure chambers 76 and branch paths 81. Piezoelectric elements 86 are fixed to the pressure plate 85.

In the matrix array head, as shown in FIG. 19, a plurality of ink supply grooves 79 (corresponding to the branch flow paths) communicating with a not shown ink supply source (corresponding to the main flow path) are formed in parallel with one another between adjacent nozzles 75 and ink passageways 77. Further, each communication hole 80 is coupled with a branch path 81 provided for each pressure chamber 76, so that an ink flow path is formed. In such a matrix array head, there is an advantage that the nozzle density in the sub-scanning direction can be increased without reducing the width of each of the pressure chambers 76.

To secure a sufficient acoustic capacitance in an ink pool is a very essential problem for the inkjet recording head.

In the ink jet recording head, by the propagation of a pressure wave applied to a certain pressure chamber, not only is an ink droplet ejected from a nozzle communicating with this pressure chamber, but so-called acoustic crosstalk is produced. The acoustic crosstalk is a phenomenon that the pressure wave is also propagated through an inlet to the ink pool communicating with the pressure chamber. When the pressure wave is propagated to an adjacent ejector through the ink pool, a bad influence may be given to the ejection condition of a nozzle other than a desired nozzle. When this influence is conspicuous, there arises a phenomenon that a small amount of ink is also ejected from the adjacent nozzle other than the nozzle which has to eject ink, In order to suppress such a bad influence of acoustic crosstalk on adjacent nozzles, it is important that the pressure wave propagated to the ink pool through the inlet is absorbed and attenuated in the ink pool so that the pressure wave is prevented from being propagated to the adjacent ejectors. It is therefore necessary to provide a sufficient acoustic capacitance in the ink pool.

In addition, in the case that the acoustic capacitance of the ink pool is insufficient, the quantity of ink supplied from the ink pool to the respective pressure chambers runs short when the ejection frequency of ink droplets is increased or when the number of nozzles to eject ink droplets concurrently is increased. Thus, a stable ejection state cannot be obtained.

FIGS. 20A to 20F schematically show the meniscus behavior, in a nozzle portion before and after the ejection of an ink droplet. A meniscus 45 having a flat form initially (FIG. 20A) moves toward the outside of the nozzle when the pressure generating chamber is compressed. Thus, an ink droplet 46 is ejected (FIG. 20B). By the ejection of the ink droplet, the ink quantity in the inside of the nozzle is reduced so that a concave meniscus 45 is formed (FIG. 20C). The concave meniscus 45 returns gradually to the nozzle aperture portion by the action of the surface tension of the ink (FIG. 20D). Then, after repeating oscillation such as a slight overshoot (FIG. 20E) and a slight concave form (FIG. 20D) of the meniscus surface, the meniscus 45 is restored to its original state before the ejection (FIG. 20F). Here, as shown in FIG. 20C, the retracting position of the meniscus surface with respect to the nozzle surface is defined as y.

FIG. 21 is a graph showing an example of the positional displacement of a meniscus immediately after ink ejection. The meniscus making a large retreat ($y=-60\ \mu m$) immediately after the ejection ($t=0$) returns to its initial position ($y=0$) while oscillating as shown in the graph. The meniscus return behavior after the ejection of an ink droplet is referred to as "refill" in this specification, and time ($t_r$) for the meniscus to be restored to the nozzle aperture surface ($y=0$) for the first time after the ejection of the ink droplet is referred to as "refill time". Of FIGS. 20A to 20F, the refill time ($t_r$) exists between FIG. 20D and FIG. 20E.

In order to eject ink droplets continuously in a stable state, it is important that next ejection is initiated after the completion of refill. In addition, in order to eject ink droplets continuously in a stable state, it is important that the meniscus shape is always retained in a fixed state immediately before ejection of an ink droplet. For example, when next ejection is initiated in the meniscus state before the completion of refill as shown in FIG. 20C, the diameter of an ink droplet ejected may be extremely small, or normal ejection of an ink droplet may be impossible, or bubbles may be caught from the nozzle surface so as to disable the nozzle from ejecting an ink droplet.

When next ejection is initiated in the state in which the meniscus is overshooted after refill with ink as shown in FIG. 20E, the axisymmetry of the meniscus shape maybe destroyed easily. Thus, bubbles may be caught from the nozzle surface so as to block ejection. Thus, if the time $t_r$ or longer has not passed since an ink droplet was ejected, next ink droplet ejection cannot be performed stably. For this reason, to secure a sufficient acoustic capacitance in the ink pool so as to achieve high-speed ink supply is an important characteristic parameter for dominating the maximum ejection frequency (that is, recording speed) of the ink jet recording head. In addition, when the refill time is not fixed among the ejectors, stable and continuous ejection cannot be achieved. It is therefore extremely important to secure a sufficient acoustic capacitance in the ink pool so as to suppress the shortage of ink supply to there by prevent a difference in refill characteristic among the ejectors.

When the quantity of an ejected ink droplet is reduced, it is possible to shorten the refill time, that is, to suppress the shortage of ink supply. In that case, however, it is impossible to obtain a sufficient printing density. When the number of nozzles ejecting ink droplets concurrently is limited or when the frequency of ejection is lowered, it may be possible to prevent the shortage of ink supply on one hand, but it is impossible to obtain a sufficient printing speed on the other hand.

As described above, in the ink jet recording head, in order to prevent acoustic crosstalk and prevent the shortage of ink supply, it is extremely important to secure a sufficient acoustic capacitance in the ink pool. A linear array head in which a pressure buffer unit has been disposed in an ink pool or on an ink pool wall is disclosed in JP-A-59-98860, JP-A-9-141864, JP-A-1-308644, or the like.

JP-A-59-98860 discloses a linear array head in which a pressure pulse absorbing member for absorbing a pressure wave is provided in a common ink chamber (corresponding to the ink pool). The pressure absorbing member is constituted by capsules wrapped in a thin plastic film. Each of the capsules is filled with gas such as the air or water vapor. JP-A-9-141864 discloses a linear array head in which a pressure absorbing member made of foam resin or, the like has been provided in an ink pool. JP-A-1-308644 discloses a linear array head in which a pressure-volume transducer made of an organic material or an elastic material and having a rate of 0.01 $mm^3$/atm or more has been provided in an ink pool or in a position adjacent to the ink pool.

Examples in which a part of the wall surface forming an ink pool is formed of an easily deformable buffer member are disclosed in JP-A-59-42964, JP-A-2000-33713, JP-A-9-314836, and so on. JP-A-59-42964 or JP-A-2000-33713 discloses a drop-on-demand type print head in which a part of the wall surface of an ink pool different from the nozzle surface is formed of a buffer member made of a flexible film material. JP-A-9-314836 discloses a laminate type ink jet recording head in which an elastically deformable area is formed in the inner surface of an ink pool. The elastically deformable area is formed not in the outer layer surface on the nozzle surface side but in the inside of an ejector. The elastically deformable area is implemented by a thin portion (recess portion) made of a metal material and provided on one surface forming the ink pool.

Each of the disclosed examples of buffer members or the like described above is a disclosed example concerning a "linear array head" in which a plurality of ejectors communicate with a single common wide ink pool. As shown in FIG. 17, in the linear array head, the ink pool 69 can be disposed in an area different from the ejector array 74. Accordingly, there is an advantage that the wide ink pool 69 can be disposed regardless of the nozzle density of the ejector array 74. Thus, in the linear array head, though there are problems in high-density arrangement of the ejectors as described previously, a sufficient capacitance can be secured in the ink pool easily by installation of a pressure wave absorbing member or the like.

In each of the disclosed examples of buffer members or the like, a damper mechanism such as a pressure relaxing unit or a thin portion is formed in the inside of each ejector. Thus, a special constituent member and a special working process are required for forming such a pressure damper. The configuration is complicated, and the working process is troublesome.

In a matrix array head, there is indeed an advantage that high density of nozzles can be achieved easily, but the head has to be formed of narrow branch flow paths. It is therefore difficult to realize a pressure damper having a sufficient capacitance. In addition, differently from a linear array head, there are a large number of pressure chambers communicating with the plurality of branch flow paths in the head. Therefore, when the pressure damper is disposed in the inside of each ejector including its pressure chamber as described above, the configuration is further complicated in comparison with the linear array head, and the working process becomes more troublesome. Thus, there arises such a problem that the manufacturing cost increases.

SUMMARY OF THE INVENTION

In consideration of such problems, it is an object of the invention to provide an ink jet recording head in which a high-density nozzle array is realized in a matrix array head, while a sufficient acoustic capacitance is secured in a plurality of branch flow paths in a simple configuration and at low cost so that acoustic crosstalk can be suppressed, the shortage of ink supply can be prevented, and high-speed ink refill operation can be achieved, and to provide an ink jet recording apparatus having such an ink jet recording head.

In order to attain the foregoing object, an ink jet recording head according to the invention including an ink supply port, a flow path to which ink is supplied from outside through the ink supply port, a plurality of ejectors communicating with the flow path, respectively, each of the plurality of ejectors including a pressure chamber communicating with the flow path, a pressure generating unit for generating a pressure wave in ink charged into the pressure chamber, and a nozzle for ejecting the ink from the pressure chamber due to the pressure wave, a nozzle plate in which the nozzles are formed, and a damper member covering the flow path for suppressing crosstalk occurring among the plurality of pressure chambers. The nozzle plate is used as the, damper member.

"Pressure damper" described in this specification is a general term of any unit for absorbing a pressure wave or any extremely easily deformable member forming a part of a wall surface.

In the ink jet recording head according to the invention, while a matrix array head having a large number of pressure chambers communicating with a plurality of branch flow paths is used, a complicated configuration in which a pressure damper is disposed in the inside of each ejector including its pressure chamber is not necessary. Thus, the working process becomes so simple that reduction in cost can be expected. In addition, a sufficient acoustic capacitance can be secured in each branch flow path without adding any special constituent member or any special working process such as providing a special pressure absorbing unit, forming a recess portion or forming a thin portion. In this case, it is preferable that one surface of walls of each branch flow path is formed in the nozzle-side outer layer surface which will be an interface with the external air layer, and the branch flow path wall is formed of a damper member having a low Young's modulus.

In addition, when the damper member is formed of a one-piece member shared by a plurality of branch flow paths, an ink jet recording head having a sufficient acoustic capacitance and capable of suppressing acoustic crosstalk sufficiently can be obtained with a low-cost and simple configuration provided for the plurality of branch flow paths.

Here, it is preferable that the damper member satisfies:

$$c_p > 10c_n \tag{1}$$

where $c_p$ designates the acoustic capacitance of the branch flow path per ejector and $c_n$ designates the acoustic capacitance of the nozzle. Alternatively, instead of the expression (1), it is also preferable that the damper member satisfies:

$$c_p > 20c_c \tag{2}$$

where $c_p$ designates the acoustic capacitance of the branch flow path per ejector and $c_c$ designates the acoustic capacitance of the pressure chamber. In these cases, not only is it possible to suppress acoustic crosstalk, but it is also possible to supply a sufficient quantity of ink to the respective ejectors from the branch flow path at a high speed. Thus, all the ejectors can eject ink droplets concurrently and stably at a high frequency.

The "acoustic capacitance $c_p$ of the branch flow path per ejector" according to the invention means a value obtained by dividing the acoustic capacitance of one branch flow path by the number of ejectors disposed to communicate with the branch flow path.

In the related art, the conditions of the acoustic capacitance of an ink pool in a linear array head to suppress acoustic crosstalk and to prevent the shortage of ink supply are disclosed in JP-A-56-75863 or JP-A-59-26269. JP-A-56-75863 (Related-Art Technique A) discloses that the volume of a common ink flow path is set to be twice or more times as large as the total sum of the volume of pressure generating chambers (including flow paths in the neighborhood) so that the occurrence of crosstalk can be suppressed. JP-A-59-26269 (Related-Art Technique B) discloses an ink jet recording head in which impedance $Z_R$ of a common ink flow path is set to satisfy the relation $Z_R \leqq Z_S/(10N)$ on the basis of the number N of ejectors connected to the common ink flow path and impedance $Z_S$ of an ink supply path so as to suppress the occurrence of crosstalk. In such a manner, in the disclosed examples (Related-Art Techniques A and B), the capacitance or impedance of the common ink flow path was set on the basis of the capacitance of the pressure generating chambers or the impedance of the ink supply path. However, from the results of experiments made by the present inventors, which will be described below, it was proved that stable ink droplet ejection could not be achieved under such conditions.

The inventors have made lots of experimental ejection observation, fluid analysis, equivalent circuit analysis, and so on. As a result, it is found that the variation amount of refill time in accordance with the number of ejectors ejecting ink droplets concurrently is dominated by the ratio of $c_p$ to $c_n$, and crosstalk is dominated by the ratio of $c_p$ to $c_c$. That is, in the ink jet recording head according to the invention, the value of $c_p$ to $c_n$ and the value of $c_p$ to $c_c$ are set to satisfy the conditions shown in the expressions (1) and (2) respectively. Accordingly, even in a head having a plurality of narrow branch flow paths as in a matrix array head, acoustic crosstalk can be suppressed, and the shortage of ink supply can be prevented. Thus, ink droplets can be ejected from a large number of ejectors continuously, concurrently and stably (U.S. patent application Ser. No. 10/118,805). Description will be made below on how the inventors have developed the invention.

First, description will be made on how the inventors have found the conditions to prevent pressure wave interference among ejectors, that is, acoustic crosstalk. The inventors have made trial production and evaluation of a large number of heads, and acoustic analysis thereof using a head equivalent circuit shown in FIG. 13. As a result, the inventors have discovered that the rate of occurrence of acoustic crosstalk depend substantially only on the ratio of $c_p$ to $c_c$. Here, the signs c, m and r in FIG. 13 designate acoustic capacitance, inertance and acoustic resistance respectively, and suffixes d, n, i, c and p designate a piezoelectric element, a nozzle, an inlet, a chamber and a branch flow path respectively. For example, $c_d$ designates, an acoustic capacitance of a piezoelectric element. Incidentally, analysis is made on the assumption that the wide main flow path had a sufficient acoustic capacitance.

With reference to the analysis of the equivalent circuit in FIG. 13, how the rate of occurrence of acoustic crosstalk changes in accordance with the change of $c_p/c_c$ is examined. FIG. 14 shows the result thereof. Here, the rate of occurrence of acoustic crosstalk is defined as:

rate of occurrence of acoustic crosstalk=$(v_2-v_1)/v_1$ on the basis of droplet velocity $v_1$ when one ejector is driven to eject an ink droplet independently and droplet velocity $v_2$ when all the ejectors are driven to eject ink droplets concurrently.

As shown in the graph of FIG. 14, the rate of occurrence of acoustic crosstalk increases gradually with the increase of the value $c_p/c_c$, increases suddenly near the point where the value $c_p/c_c$ exceeds 0.1, and reaches a peak when the value $c_p/c_c$ is 1–2. After that, the acoustic crosstalk decreases suddenly with the increase of $c_p/c_c$, and then it is understood that the rate of occurrence of acoustic crosstalk can be suppressed to 7–8% or less if the condition $c_p>20c_c$ is satisfied.

It is understood that the rate of occurrence of acoustic crosstalk can be more preferably suppressed to 5% or less if $c_p>50c_c$, and to 1% or less if $c_p>100c_c$. Acoustic crosstalk increases conspicuously when the value $c_p/c_c$ is 1–2. The reason causing the increase can be considered as follows. That is, a pressure wave propagated from a pressure chamber brings about oscillation of a pressure wave in the ink in a branch flow path. Since the oscillation frequency of the pressure wave oscillation produced in the branch flow path is close to the oscillation frequency of the pressure wave oscillation in the pressure chamber, both the oscillations interfere with each other, causing a kind of resonance phenomenon.

Strictly, the inertance $m_p$ or the acoustic resistance $r_p$ of the branch flow path also has an influence on the rate of occurrence of acoustic crosstalk. In an ordinary ink jet recording head, however, it is found that the influence is extremely small so that the rate of occurrence of acoustic crosstalk is substantially dominated by the value $c_p/c_c$ as described above. The absolute value of the rate of occurrence of acoustic crosstalk varies in accordance with the head shape such as the nozzle shape, the inlet shape, or the pressure chamber shape. It is, however, confirmed that the correlation of increase/decrease of the rate of occurrence of acoustic crosstalk with the value $c_p/c_c$ is constant regardless of the head shape as shown in FIG. 14.

In the same manner, the inventors carry out trial production and evaluation of heads, and analysis of their equivalent circuits. As a result, the inventors discover that the ink refill time depended on the ratio of $c_p$ to $c_n$. FIG. 15 is a graph showing the result of an examined relationship between the value $c_p/c_c$ and the refill time $t_r$. From the graph, it is proved that the refill time is substantially constant regardless of the value $c_p/c_n$ before the value $c_p/c_n$ reaches 1, but the refill time increases suddenly when the value $c_p/c_n$ exceeds 1, and then reaches a peak when the value $c_p/c_n$ is 3–4. After that, the refill time decreases suddenly with the increase of $c_p/c_n$. Thus, it is made clear that the refill time can be prevented from increasing suddenly if the condition $c_p>10c_n$ is satisfied.

The reason why the refill time increases suddenly to reach a peak when the value $c_p/c_n$ is 3–4 can be considered as follows. That is, a pressure wave in a pressure chamber interferes with a pressure wave in a branch flow path in the same manner as in the case of acoustic crosstalk. The absolute value of the refill time varies in accordance with the head shape such as the nozzle shape, the inlet shape, or the pressure chamber shape. It is, however, confirmed that the correlation of increase/decrease of the refill time with the value $c_p/c_n$ is constant regardless of the head shape as shown in FIG. 15.

From the result of trial production of a plurality of kinds of ink jet recording heads, the following fact is made clear. That is, the influence of the inertance $m_p$ and the acoustic resistance $r_p$ of the branch flow path on the increase of the refill time are also small. Thus, in an ordinary ink jet recording head, it will go well if the properties of branch flow paths are set on the basis of the value $c_p/c_n$.

As described above, the inventors have found that in order to suppress acoustic crosstalk and the shortage of ink supply, it goes well if the two conditions of $c_p>10c_n$ and $c_p>20c_c$ are satisfied. In addition, it is also found that particularly with the setting in a range of $0.1<c_p/c_c<10$ or $1<c_p/c_n<10$, extremely great acoustic crosstalk occurs or the refill time increases suddenly. The ink jet recording head according to the invention has a feature in that the acoustic capacitance of the ink pool is optimally set to satisfy the two conditions of $c_p>10c_n$ and $c_p>20c_c$ on the basis of these results. When the conditions are satisfied, even in a matrix array head having narrow branch flow paths, it is possible to suppress the increase of refill time and suppress acoustic crosstalk.

In the ink jet recording head according to the invention, when the damper member is disposed on the nozzle outer layer surface side in a matrix array head, the damper member can be used also as the nozzle plate. As a result, nozzles can be formed directly in the damper member. With such a configuration, the number of parts and the number of manufacturing steps are reduced. Thus, even in a matrix array head having a plurality of branch flow paths, a pressure damper can be formed at low cost.

In the ink jet recording head according to the invention, it is preferable that the plate thickness of the damper member is not smaller than 20 $\mu$m and not larger than 100 $\mu$m. When nozzles are formed in the damper member, it is important to optimize the plate thickness of the damper member so that the pressure damper function and the nozzle function can be made compatible. When the plate thickness of the damper member is reduced, it is indeed possible to increase the acoustic capacitance of the ink pool. But it is proved that when the plate thickness is reduced excessively, there arose a problem that bubbles are apt to be caught from the nozzle surface when ink droplets are ejected.

The inventors investigate the relationship between the nozzle length and the catch of bubbles. As a result, it is experimentally confirmed that the nozzle length has to be 20 μm or more in order to prevent bubbles from being caught. On the other hand, when the nozzle is extremely long, the inertance of the nozzle increases. Thus, there arises a problem that the efficiency in ejection becomes so low that the refill time increases. In addition, in an ordinary ink jet recording head, the nozzle diameter is about ϕ30 μm or less. However, to form such minute nozzles on a nozzle plate with high precision, there is a processing limit in the nozzle length. In order to satisfy these conditions, it was experimentally confirmed that the nozzle length had to be not larger than 100 μm, preferably not larger than 75 μm.

In the related-art matrix array heads, there is no description on specific implements for providing a pressure damper for a branch flow path. Japanese Patent No. 2806386 and Japanese Translation of PCT publication No. Hei.10-508808 (U.S. Pat. No. 5,757,400) disclose an ink jet head in which a nozzle plate formed a nozzle is used as a member covering a branch flow path. However, both references do not discloses that this member suppresses the cross talk in the branch flow path, at all.

In the ink jet recording head according to the invention, it is desired that the damper member is made of a film-like organic compound. Examples of such film-like organic compound may include acrylic resin, aramid resin, polyimide resin, aromatic-polyamide resin, polyester resin, polystyrene resin, nylon resin, and polyethylene resin.

Generally, metal materials such as stainless steel, glass, ceramics, organic compounds, etc. may be used as the head constituent members. It is, however, preferable that an organic compound having a small elastic coefficient (Young's modulus) is used to achieve a satisfactory pressure damper function. In addition, in the ink jet recording head according to the invention, it is necessary to form nozzles in the damper member. When such a film-like organic compound is used, nozzles can be formed easily with high precision by excimer laser processing. The damper member can be indeed formed of a metal material or ceramic. But, when a metal material or ceramic whose Young's modulus isone or two digits larger than that of such an organic compound is applied to a matrix array head having narrow branch flow paths, it is necessary to form the damper member to be extremely thin.

In this ink jet recording head in which the damper member can be arranged to be exposed on the nozzle outer layer surface side, unexpected excessive stress may act on the damper member due to jamming of the paper or the like. It is therefore practically difficult to use an extremely thin metal material as the damper member. On the other hand, when the damper member is formed of a film-like organic compound, the plate thickness of the damper member can be made several times as thick as that in the case of a metal material. Thus, there can be obtained an effect that the damper member is not broken by external force caused by paper jamming or the like.

When the film-like organic compound is made of polyimide resin, the polyimide resin has a high heat resistance temperature. Accordingly, when polyimide resin is used for the damper member, a heat process, for example, at 270° C., can be used in any processes after the head is assembled. Generally, various bonding-processes are used for assembling ink jet recording heads. When polyimide resin is used for the damper member, various thermosetting adhesive agents or various thermoplastic adhesive agents may be used. For example, when polystyrene resin is used for the damper member, an epoxy-based adhesive agent having a setting temperature of 200° C. cannot be used. In addition, polyimide resin is a chemically stable material, and has a feature of having a superior chemical resistance to ink. Further, polyimide resin also has a feature in that nozzles can be processed out of the resin with extremely high precision without any burr or the like by excimer laser. Incidentally, "polyimide resin" described in this specification means a high polymer compound having an imide bond in its principal chain.

In a preferred ink jet recording head according to the invention, the pressure generating unit includes a piezoelectric element and a pressure plate for transmitting displacement of the piezoelectric element to the ink in the pressure chamber, and a maximum droplet quantity the pressure generating unit can eject is set to be not smaller than 15 pl (pico-liter). In this case, a large ink droplet of 15 pl or more can be ejected. Accordingly, a good image can be formed with printing resolution in a range of from 300 dpi to 600 dpi. In comparison with the case of printing with high resolution of 1,200 dpi, much higher speed printing can be achieved. In addition, it is preferable that the pressure generating unit having the piezoelectric element and the pressure plate is constituted by a piezoelectric actuator in which the pressure plate is flexibly deformed in accordance with extensible deformation of the piezoelectric element. In this case, a matrix array head can be realized easily To print good characters or good images in an ink jet recording system, printing resolution of at least 300 dpi, preferably 600 dpi or higher, is required. From the fact that almost all of ink jet recording printers manufactured currently have resolution of 300 dpi or higher, it is understood that the resolution is an indispensable condition to secure image quality (excluding a draft print mode for high speed printing).

When printing is performed in the printing resolution of 300 dpi by use of water-based dye ink generally used, a maximum ejected droplet quantity of at least 15 pl, preferably 20 pl or more, is required for obtaining a sufficient image density without any color missing. Similarly, when printing is performed in the printing resolution of 600 dpi, a maximum ejected droplet quantity of at least 10 pl, preferably 15 pl or more, is required even by use of ink having a composition adjusted to extend its dot diameter on recording paper within a range not to degrade the image quality extremely. When the printing resolution is further enhanced, a required maximum droplet quantity is reduced. In this case, however, there arises a problem that the printing speed is lowered as will be described below. For example, when printing is performed in the resolution of 1,200 dpi, an image with sufficient density can be formed by a maximum droplet quantity of about 4–5 pl. However, when the printing resolution is improved, the printing data volume increases. Thus, when the number of nozzles is not changed, there arises a problem that the printing speed is reduced in accordance with the increase of the resolution. On the contrary, when the printing resolution is lowered to achieve high speed printing, there arises a problem that the image quality is degraded.

As a printing method to solve such conflicting problems and make the printing speed and the image quality compatible, there is known a droplet diameter modulation recording system in which the droplet quantity of an ejected liquid droplet is controlled. In the droplet diameter modulation recording system, a piezoelectric element is used as a pressure generating unit, and the waveform of a driving voltage to be applied to the piezoelectric element is controlled. Thus, the droplet diameter modulation recording system has a feature in that any droplet ranging from a small droplet having a small droplet quantity to a large droplet having a large droplet quantity can be ejected from one and the same nozzle. In combination of such a droplet diameter modulation technique, the image quality equivalent to that achieved by recording in high resolution of 1,200 dpi can be achieved in the printing resolution in a range of from 300 dpi to 600 dpi. However, even if the droplet diameter modulation technique is used, printing resolution is dominant over the character quality. For the character quality, the printing resolution of at least 300 dpi, preferably 600 dpi is required.

This ink jet recording head achieves the compatibility of the printing speed and the image quality with each other as described above. In addition, in order to adopt the droplet diameter modulation technique to achieve an excellent image and high speed printing in the resolution ranging from 300 dpi to 600 dpi, the ink jet recording head is configured as follows. That is, a piezoelectric element and a pressure plate for transmitting the displacement of the piezoelectric element to the ink in the pressure chamber are included as the pressure generating unit. In addition, a droplet quantity of at least 15 pl can be ejected. In this ink jet recording head, the pressure damper is designed so that even large ink droplets of 15 pl can be ejected continuously and stably at a high ejection frequency.

Pressure generating units using piezoelectric elements are roughly classified into a single-layer piezoelectric actuator and a multi-layer piezoelectric actuator. The single-layer piezoelectric actuator uses the flexible deformation of an actuator constituted by a piezoelectric element and a pressure plate, as its output. On the other hand, the multi-layer piezoelectric actuator uses the extensible deformation of a piezoelectric element made of a plurality of piezoelectric element layers laminated to one another, as its output. In a matrix array head having ejectors arrayed two-dimensionally, it is difficult to use such a multi-layer piezoelectric actuator from the point of view of the mounting technology and the manufacturing cost. It is preferable that an inexpensive single-layer piezoelectric actuator is used as the pressure generating unit.

Liquid ejected from nozzles is generically referred to as "ink" in this specification. Examples of such ink ejected from the nozzles in the ink jet recording head according to the invention may include printing ink, liquid containing an organic EL device material, or liquid containing an organic semiconductor material. When printing ink is used, the ink jet recording head can be applied to an ink jet recording apparatus which can obtain an excellent image. When liquid containing an organic EL device material is used, the ink jet recording head can be applied to an organic EL display manufacturing device, an organic EL display manufacturing head, and an organic EL display manufacturing apparatus, each using an organic EL display substrate as a target of application with the liquid. Further, when liquid containing an organic semiconductor material is used, the ink jet recording head can be applied to an organic semiconductor device manufacturing device, an organic semiconductor device manufacturing head, and an organic semiconductor device manufacturing apparatus, each using an organic semiconductor device substrate as a target of application with the liquid.

DETAILED DESCRIPTION OF THE PREFERRED EMBODIMENTS

The invention will be described below further in detail on the basis of embodiments thereof with reference to the drawings.

First Embodiment

Figure 1:
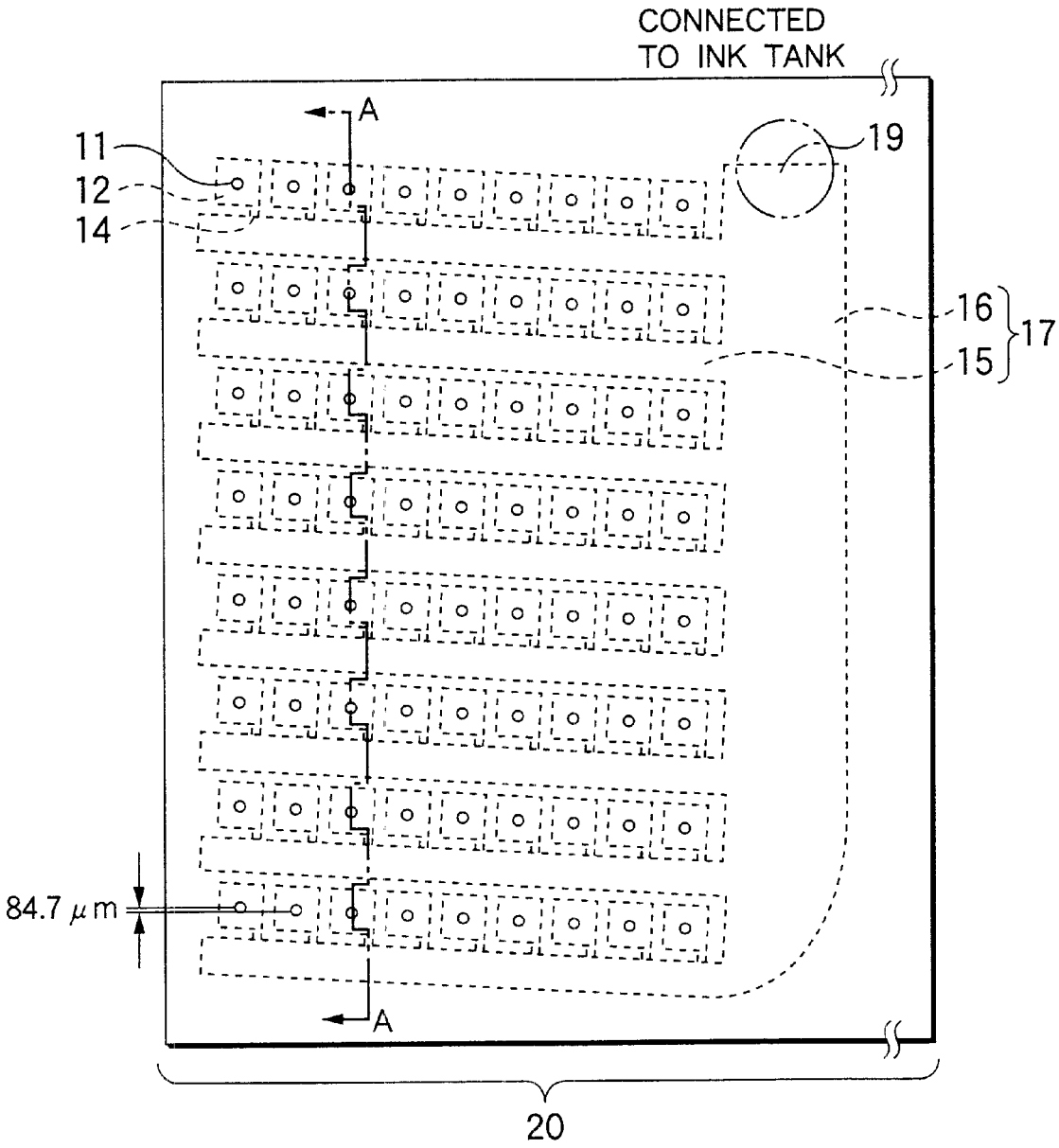
FIG. 1 is a plan view schematically showing an ink jet recording head according to a first embodiment of the invention.
Figure 2:
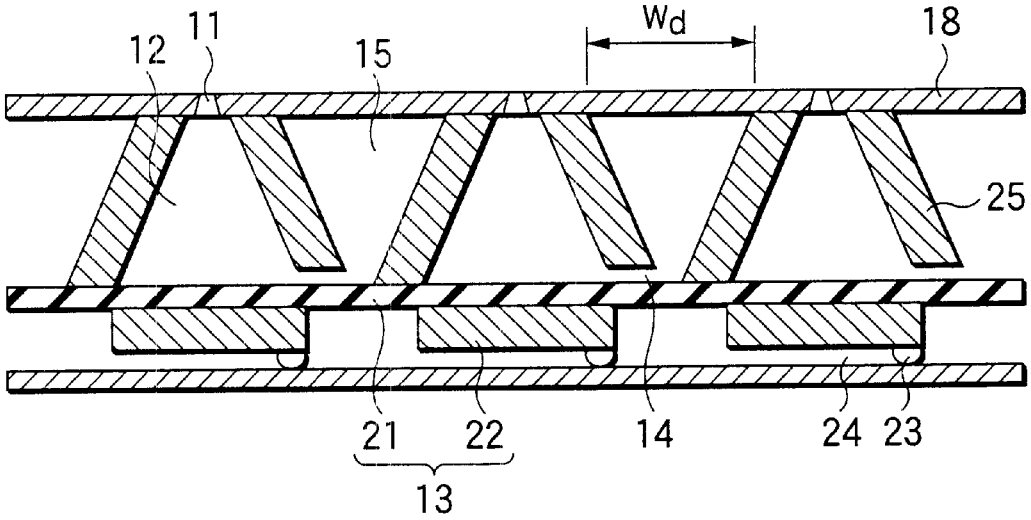
FIG. 2 is a sectional view showing the ink jet recording head according to the first embodiment.

FIG. 1 is a plan view showing the configuration of an ink jet recording head (hereinafter, occasionally referred to as "recording head" simply) according to a first embodiment of the invention FIG. 2 is a sectional view taken on line A—A in FIG. 1.

As shown in FIG. 1, an ink jet recording head (ink jet ejection element) 20 according to this embodiment has an ink pool 17 supplied with ink from an external ink tank (not shown) through an ink supply port 19, and a plurality of ejectors arrayed in a matrix. The ink pool 17 is constituted by a single, linear main flow path 16, and linear branch flow paths 15 branching from the main flow path 16 substantially perpendicularly to the main flow path 16, and in parallel to one another. Each of the ejectors has a pressure chamber 12, a pressure generating unit 13 and a nozzle 11 as shown in FIG. 2. The pressure chamber 12 communicates with the corresponding one of the branch flow paths 15 through an inlet 14. The pressure generating unit 13 is constituted by a pressure plate 21 and a single-plate piezoelectric element 22 which are disposed on the bottom of the pressure chamber 12.

When a driving voltage waveform is applied from a drive circuit (not shown) to the piezoelectric element 22, the pressure plate 21 is flexibly deformed in accordance with the expansion and contraction deformation of the piezoelectric element 22, so that the volume of the pressure chamber 12 can be expanded or contracted. In accordance with the sudden change in volume of the pressure chamber 12, a pressure wave is generated in the ink in the pressure chamber 12 so as to eject an ink droplet from the nozzle 11. Here, a rolled stainless steel thin plate is used as the pressure plate 21, and the pressure plate 21 is used as a common electrode for supplying the driving voltage waveform to the piezoelectric elements 22. As shown in FIG. 2, the driving voltage waveform applied to each of the piezoelectric elements 22 is supplied through a bump 23 from a flexible print circuit 24 disposed under the piezoelectric elements 22.

One-side surfaces of the branch flow paths 15 are formed of a damper member 18 disposed on the outer layer surface side of the nozzles 11. A plurality of nozzles 11 are formed in the damper member 18 so as to be arrayed in a matrix. An ink repellent material repelling the ink is applied to the peripheries of the nozzles 11 on the damper member 18. The damper member 18 is made from a polyimide resin film having a Young's modulus of 8 GPa. Each of the nozzles 11 is formed by excimer laser processing so as to have an aperture diameter of 30 $\mu$m.

The damper member 18 is formed of a one-piece damper member 18 shared by a plurality of branch flow paths 15. By coating the plurality of branch flow paths 15 with the one-piece damper member 18, a pressure damper mechanism is formed in a lump on the respective branch flow paths 15. In this embodiment, one surface of the main flow path 16 is formed on the outer layer surface on the side of the nozzles 11 in the same manner as the branch flow paths 15. Thus, the outer layer surface of the main flow path 16 on the side of the nozzles 11 is formed of the damper member 18 provided on the branch flow paths 15. With such a configuration, an acoustic capacitance enough to prevent the shortage of ink supply can be provided also for the main flow path 16.

In this recording head, as shown in FIG. 1, 9 ejectors are provided to communicate with each branch flow path 15, and the respective ejectors are disposed so that the pitch of the ejectors in the sub-scanning direction is 300 pieces/inch; that is, about 84.7 $\mu$m. In addition, the number of the branch flow paths 15 is 8. Thus, one ink jet ejection element 20 for one is color is constituted by 72 ejectors in total.

This recording head was manufactured as follows. As shown in FIG. 2, the ink flow path extending from the main flow path 16 (FIG. 1) to the nozzles 11 through the branch flow paths 15, the inlets 14 and the pressure chambers 12 is constituted by three plates, that is, the ejector plate 25, the damper member 18 and the pressure plate 21.

In the ejector plate 25, a plurality of pressure chambers 12 arrayed in a matrix, a plurality of branch flow paths 15 each formed in a straight line and having an inverted-triangular shape in section, and inlets 14 making communication between the branch flow paths 15 and the pressure chambers 12 are formed. An Si substrate was used as the ejector plate 25. By use of a general semiconductor process of exposure, development and film formation, and an anisotropic wet etching process using the (100) plane of Si, the quadrangular-pyramid-like pressure chambers 12, the inlets 14 and the branch flow paths 15 are formed integrally on the ejector plate 25. Each of the inlets 14 is formed to have an inverted triangular shape in section 68 $\mu$m wide and 48 $\mu$m high, and to be 100 $\mu$m long.

Next, the damper member 18 made from a polyimide resin film is fixed to the ejector plate 25 by a thermoplastic adhesive agent. After that, the nozzles 11 are formed in positions corresponding to the pressure chambers 12 in the damper member 18, respectively by excimer laser processing. Further, the pressure plate 21 made of stainless steel is fixed to the surfaces of the pressure chambers 12 opposite to the nozzles 11 by a thermoplastic adhesive agent, and the piezoelectric elements 22 are fixed to the pressure plate 21 in positions corresponding to the pressure chambers 12 by bonding. Electrodes (not shown) are formed in the opposite surfaces of each of the piezoelectric elements 22 in advance by a sputtering method. Finally, the flexible print circuit 24 is connected to the piezoelectric elements 22 through the solder bumps 23. Thus, the manufacturing process of the recording head is terminated.

Figure 3:
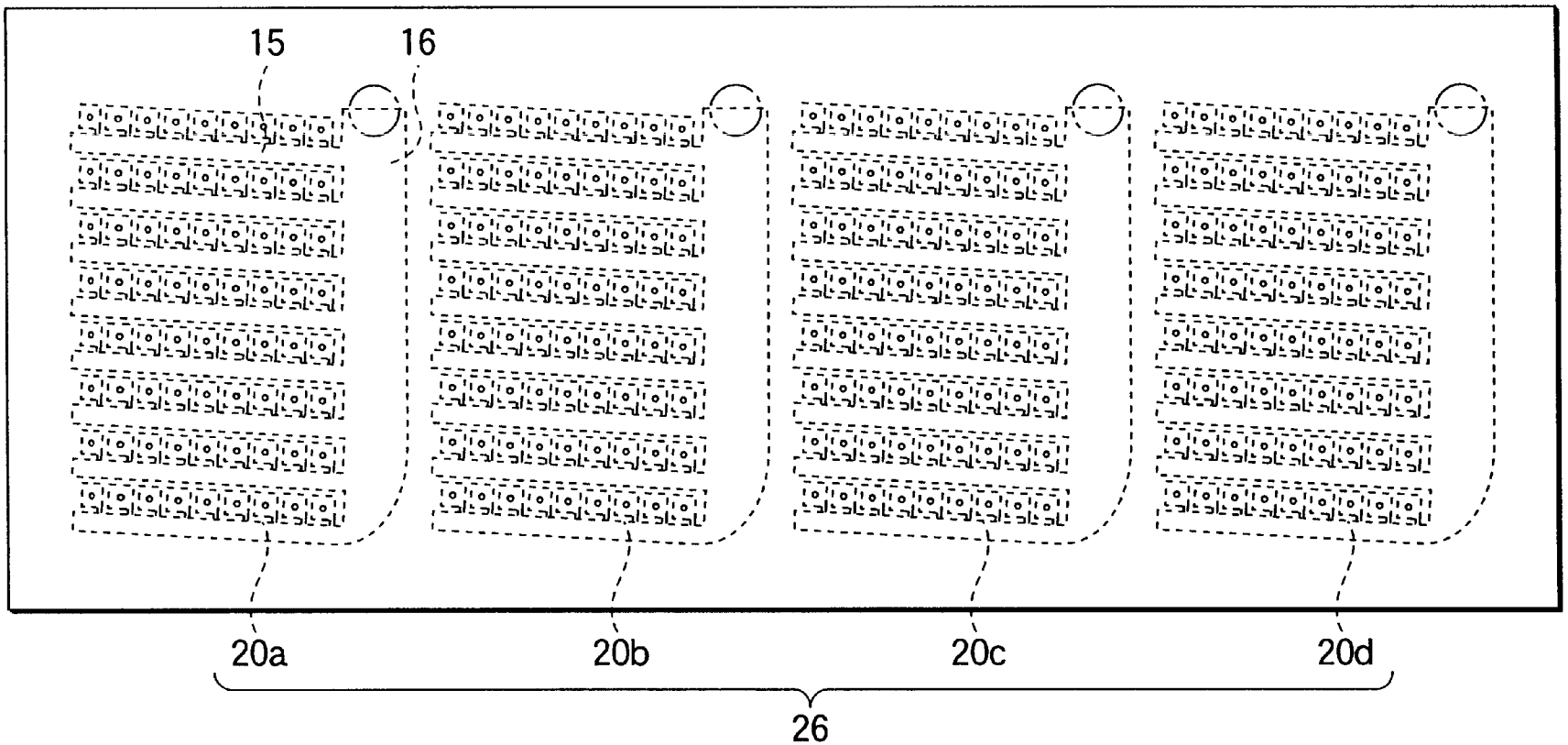
FIG. 3 is a plan view showing the ink jet recording head according to the first embodiment.

FIG. 3 is a plan view showing the ink jet recording head according to this embodiment. This ink jet recording head 26 has four ink jet ejection elements 20*a* to 20*d* arrayed in a line in the main-scanning direction integrally. Each of the ink jet ejection elements 20*a* to 20*d* has a main flow path 16, a plurality of branch flow paths 15, and a plurality of ejectors arrayed in a matrix. Black ink is charged into the ink jet ejection element 20*a*. Magenta ink is charged into the ink jet ejection element 20*b*. Cyan ink is charged into the ink jet ejection element 20*c*. Yellow ink is charged into the ink jet ejection element 20*d*.

Next, in this embodiment, description will be made on the relationship of acoustic capacitance among the nozzle 11, the pressure chamber 12 and the branch flow path 15. In FIG. 2, for example, the width $W_d$ of the branch flow path 15 may be set at 637 $\mu$m, and a polyimide resin film having 20 $\mu$m in plate thickness and 8 GPa in Young's modulus may be used as the damper member 18. In addition, each of the nozzles 11 on the damper member 18 may be formed to be 30 $\mu$m in diameter by excimer laser processing. Water-based ink having 3 mPa·s in viscosity and 35 mN/m in surface tension may be used as the ink.

The acoustic capacitance $c_c$ of the pressure chamber 12 can be expressed by the following expression. Here, $W_c$ designates the pressure chamber volume [$m^3$], κ designates the volume modulus [Pa] of the ink, and K designates a correction coefficient depending on the rigidity of the pressure chamber and so on.

$$c_c = \frac{W_c}{\kappa \cdot K} \tag{3}$$

For example, the pressure chamber 12 in this embodiment shows a quadrangular-pyramid-like shape having 500 $\mu$m square in its bottom surface and 350 $\mu$m high, and its volume is set at $2.9\times10^{-11}$ $m^3$. Since the volume modulus of the water-based ink was $2.2\times10^9$ Pa, and the correction coefficient K obtained by experimental evaluation is 0.3, the value $c_c$ is $4.4\times10^{-20}$ [$m^5$/N].

The acoustic capacitance $c_n$ of the nozzle can be expressed by the following expression when $d_n$ [m] designates the nozzle aperture diameter, $\sigma$ [N/m] designates the ink surface tension, y [m] designates the retracting quantity of a meniscus, and the shape of the meniscus is approximated to a parabola.

$$c_n = \frac{\pi d_n^4}{64\sigma}\sqrt{1+\frac{16y^2}{d_n^2}} \tag{4}$$

As shown in the expression (4), the acoustic capacitance $c_n$ of the nozzle depends on the retracting quantity y of the meniscus. In this embodiment, the value $c_n$ was estimated by the following expression using the definition of $y=d_n/4$.

$$c_n = \frac{\pi d_n^4}{48\sigma} \tag{5}$$

In this embodiment, the nozzle diameter is 30 $\mu$m, and the surface tension of the ink is 35 mN/m. Thus, the value $c_n$ is $1.5\times10^{-10}$ [$m^5$/N].

In this embodiment, the outer layer surface of the branch flow path 15 on the side of the nozzle 11 is formed of the damper member 18 so as to be provided with a pressure damper. Since the pressure damper in this embodiment has an both-ends-support beam structure, the acoustic capacitance $c_d$ of the pressure damper formed on the branch flow path 15 can be approximated by the following expression. Here, $W_d$ designates the branch flow path width [m], $t_d$ designates the thickness [m] of the damper member, $l_d$ designates the length [m] of the branch flow path per ejector, $E_d$ designates the elastic modulus (Young's modulus) [Pa] of the damper member, and $v_d$ designates the Poisson's ratio of the damper member.

$$c_d = \frac{l_d w_d^5(1-v_d^2)}{60E_d t_d^3} \tag{6}$$

In the recording head according to this embodiment, as described above, the width $w_d$ of the branch flow path 15 is set at 637 $\mu$m, and the distance $l_d$ between ejectors is set at 700 $\mu$m. In addition, a polyimide film having 8 GPa in elastic modulus, 0.4 in Poisson's ratio and 20 $\mu$m in thickness is used as the damper member 18. Accordingly, the acoustic capacitance cd of the pressure damper per ejector is obtained as:

$$c_d=1.6\times10^{-17}[m^5/\mathrm{N}]$$

In this recording head, the acoustic capacitance of the ink itself charged into the branch flow path 15 is extremely low so that the acoustic capacitance of the branch flow path 15 can be regarded as substantially equal to the acoustic capacitance of the pressure damper. Therefore, the acoustic capacitance $c_p$ of the branch flow path 15 is obtained as:

$$c_p=1.6\times10^{-17}[m^5/\mathrm{N}]$$

As is apparent from the calculation results of the respective parameters, in the recording head according to this embodiment, the acoustic capacitance $c_p$ of the branch flow path 15 is 10.7 times as high as the acoustic capacitance $c_n$ of the nozzle, and the acoustic capacitance $c_p$ of the branch flow path 15 is about 363 times as high as the acoustic capacitance $c_c$ of the pressure chamber 12. Thus, both the conditions of the expressions (1) and (2) are satisfied.

Figure 4:
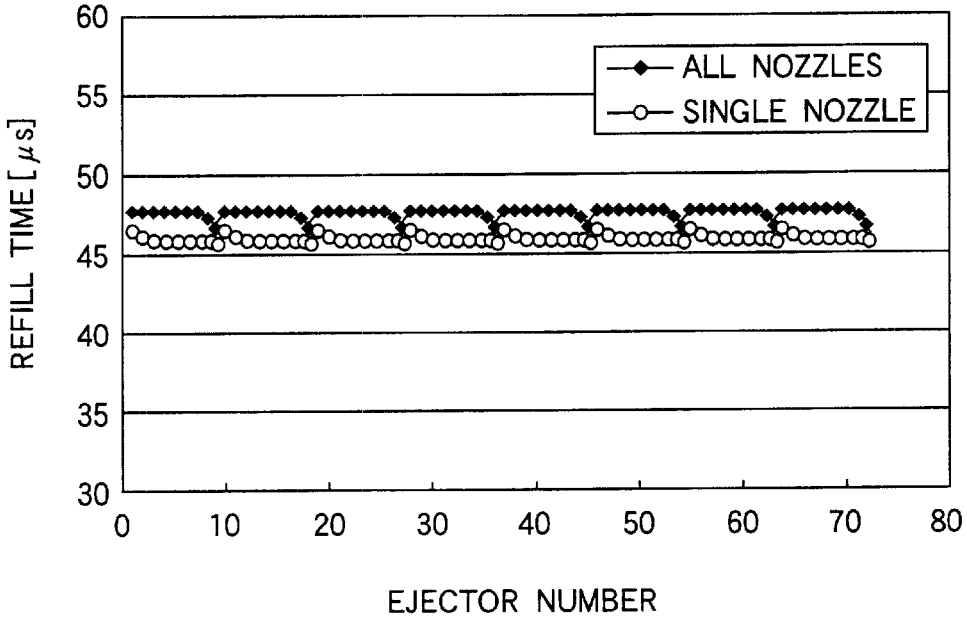
FIG. 4 is a graph showing the ejection characteristic of the ink jet recording head according to the first embodiment.

By use of the recording head according to this embodiment, ink droplets of 15 pl are ejected while the number of ejectors ejecting the ink droplets concurrently is varied and the refill time is examined. This result is shown in the graph of FIG. 4. It is understood from this graph that the difference between the refill time when one ejector ejects an ink droplet independently and the refill time when all the ejectors ejected ink droplets concurrently is ±1 $\mu$s or less, and both the refill times are substantially coincident with each other. In addition, the average refill time (the symbol ♦) when all the ejectors are driven to eject ink droplets concurrently is 47.5 $\mu$s, and the average refill time (the symbol ○) when one ejector is driven to eject an ink droplet independently is 45.9 $\mu$s. The refill times of respective ejectors are coincident with one another in the deviation of ±0.4 $\mu$s or less.

In the recording head according to this embodiment, the driving voltage waveform to be applied to the piezoelectric element 22 is adjusted so that the ink droplet diameter ejected from the nozzle 11, can be varied easily. Therefore, the driving voltage waveform to be applied to the piezoelectric element 22 is adjusted, and the refill time when an ink droplet of 20 pl is ejected is examined. That is, when an ink droplet of 20 pl is ejected, the droplet volume increases in comparison with that in the case where an ink droplet of 15 pl is ejected. Accordingly, the refill time becomes a little longer, but it is confirmed that the refill time when one ejector is driven to eject an ink droplet independently and the refill time when all the ejectors are driven to eject ink droplets concurrently are coincident with each other in the deviation within ±2.0 $\mu$s. The average refill time of all the ejectors when each ejector eject an ink droplet independently is 57.0 $\mu$s. The average refill time of all the ejectors when all the ejectors eject ink droplets concurrently is 60.4 $\mu$s. In addition, it is confirmed that all the ejectors can eject ink droplets of 20 pl concurrently, stably and continuously at an ejection frequency of 15 kHz.

From the measuring result of the refill time, it is confirmed that the pressure damper mechanism constituted by the damper member 18 operates satisfactorily so that the shortage of ink supply can be suppressed. The refill time is measured as follows. That is, the meniscus state of the nozzle surface is observed in a magnified mode synchronously by a stroboscope. Then, the time for the meniscus surface to be restored to its initial state is measured. The measuring accuracy of the refill time is about ±1 $\mu$s. Incidentally, the abscissa in FIG. 4 designates ejector numbers set so that ejector No. 1 is assigned to the ejector in the left upper end in FIG. 1, ejectors No. 2, No. 3, . . . are assigned to the ejectors adjacent thereto sequentially, and ejector No. 72 is assigned to the ejector in the right lower end.

In such a manner, it is confirmed that a sufficient acoustic capacitance can be given to the narrow branch flow paths 15 when the damper member 18 is formed of a polyimide film having 20 $\mu$m in thickness and 8 GPa in Young's modulus. Then, all the ejectors are driven to eject ink droplets continuously, and it is examined whether the ink droplets can be ejected stably at a high frequency of 20 kHz or not. As a result, it is confirmed that even when ink droplets of 15 pl are ejected from all the ejectors concurrently at a frequency of 20 kHz, ejection can be achieved as stably as that when each ejection ejects an ink droplet independently. In addition, the droplet velocity is measured to examine the influence of acoustic crosstalk. As a result, it is confirmed that the droplet velocity at the time of independent ejection from a single ejector and the droplet velocity at the time of concurrent ejection from all the ejectors are coincident with each other in the deviation within ±2%. From this result, it is confirmed that acoustic crosstalk among the ejectors can be suppressed well.

Figure 5:
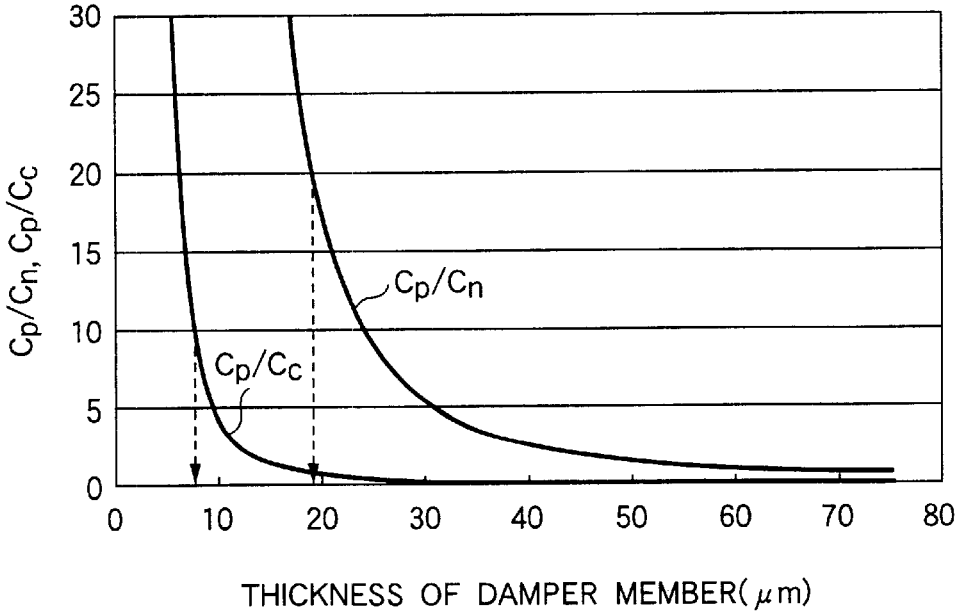
FIG. 5 is a graph showing the relationship between the plate thickness of a damper member and the acoustic capacitance of a nozzle, a pressure chamber and a branch flow path in an ink jet recording head representing a comparative example for the first embodiment.

As a subject of comparison, a stainless steel plate ($E_d$=197 GPa, and v=0.3) was used as the damper member 18, and similar evaluation was performed thereon. First, the relationship between the thickness of the damper member 18 and the acoustic capacitance $c_p$ of the branch flow path 15 was obtained by the expression (6), and how the values $c_p/c_n$ and $c_p/c_c$ changed in accordance with the plate thickness of the dampermember 18 was obtained by theoretical expressions. The results are shown in FIG. 5. It was proved from the graph of FIG. 5 that when a stainless steel plate was used as the damper member 18, the plate thickness of the damper member 18 had to be reduced to 7 μm in order to satisfy the expression (1) for suppressing the shortage of ink supply and achieving high-speed ink refill. In addition, it was proved that the plate thickness of the damper member 18 had to be made not larger than 19 μm in order to satisfy the expression (2) for suppressing acoustic crosstalk. In order to verify the analytic results, the plate thickness of the stainless steel damper member 18 were varied variously, and evaluation similar to the evaluation made in the case where the polyimide damper member was used was performed.

COMPARATIVE EXAMPLE 1

In this comparative example, the plate thickness of the stainless steel damper member 18 was set at 10 μm. In the ink jet recording head in this comparative example, the value $c_p$ was;

$$c_p=5.2\times10^{-18}[m^5/N]$$

($c_p/c_n$=3.5, and $c_p/c_c$=137, satisfying the expression (2), but not satisfying the expression (1).

Figure 6:
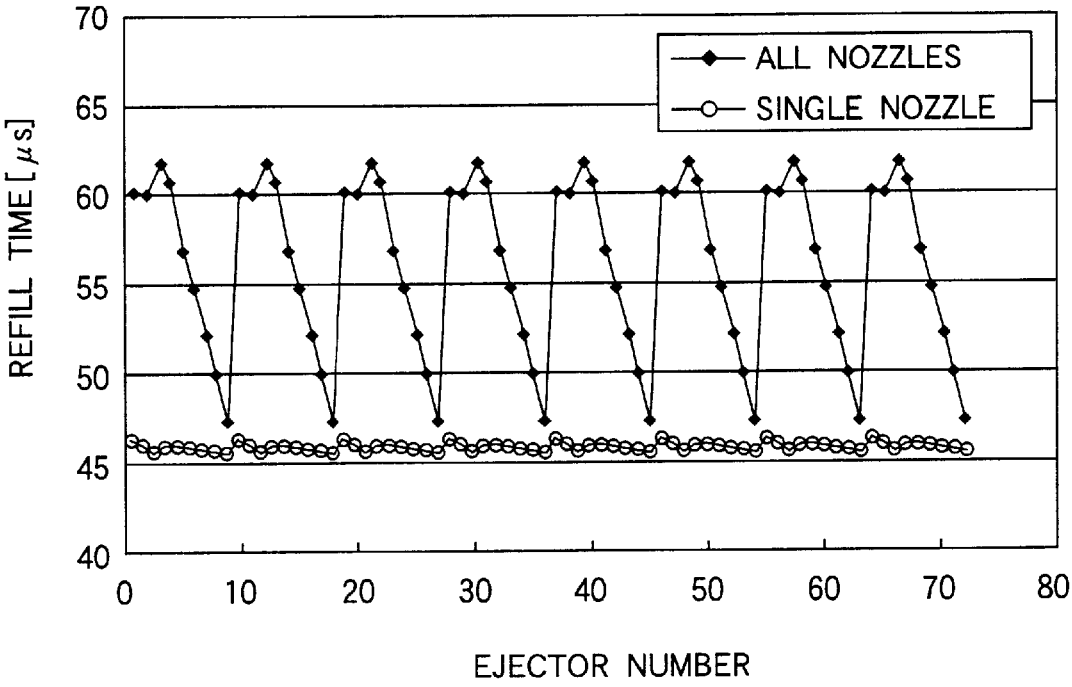
FIG. 6 is a graph showing the ejection characteristic of the ink jet recording head representing a comparative example for the first embodiment.

The ink refill time when ink droplets of 15 pl were ejected was examined. FIG. 6 shows the result thereof. It is understood from the graph that when concurrent ejection from all the ejectors is performed, the shortage of ink supply occurs, and the refill time increases on a large scale in comparison with the case where each ejector is driven independently. Ejection at an ejection frequency of 20 kHz was evaluated. As a result, it was confirmed that stable ejection could be achieved when each ejection was driven independently, but a large number of ejectors were in an unstable ejection state when all the ejectors were driven to eject ink droplets concurrently. In the case where each ejector is driven independently, one ejector can occupy one branch flow path 15. Thus, the acoustic capacitance of the branch flow path 15 per ejector increases to several times as large as that in the case of concurrent ejection from all the ejectors. It can be therefore considered that stable ejection at the ejection frequency of 20 kHz could be achieved in the case where each ejector is driven independently.

The acoustic capacitance $c_p=5.2\times10^{-18}$ [$m^5$/N] shows the value at the time of concurrent ejection from all the ejectors. It was, however, proved that at the time of concurrent ejection from all the ejectors, the acoustic capacitance of the branch flow path 15 ran short so that the difference in refill time occurred among a plurality of ejectors communicating with one branch flow path 15 as follows. As is understood from the graph of FIG. 6, the refill time was about 47 μs in each ejector close to the main flow path, allowing ejection at the ejection frequency of 20 kHz. On the other hand, the refill time was not shorter than 60 μs in each ejector in the end far from the main flow path. This refill time was 13 μs or longer than that in the ejector close to the main flow path.

Accordingly, the ejectors in the end far from the main flow path were in an unstable ejection state at the ejection frequency of 20 kHz to thereby bring about a result that some of the electors could not make ejection. In concurrent ejection from all the ejectors, stable ejection could be achieved when the ejection frequency was reduced to about 13–15 kHz. It can be considered that the acoustic capacitance of the branch flow path 15 when each ejector is driven independently increases to several or more times as large as that when all the ejectors are driven concurrently. These results are substantially coincident with the analytic results shown in FIG. 15. Thus, the effectiveness of the invention could be also confirmed experimentally.

The ink jet recording head manufactured by way of trial and evaluated as a subject of comparison satisfies the conditions of the related-art technique A and the related-art technique B. That is, it was confirmed that even when the feature of the common ink flow path was set according to the related-art techniques, and stable ejection at a high frequency could not be achieved, stable, continuous and concurrent ejection from all the nozzles could be achieved after the acoustic capacitance $c_p$ of the common ink flow path was optimally set in accordance with the acoustic capacitance $c_n$ of the nozzle. Similarly to the first embodiment of the invention, the droplet velocity at the time of independent ejection from a single ejector and the droplet velocity at the time of concurrent ejection from all the ejectors were coincident with each other in the deviation within ±2%. From this fact, it could be confirmed that acoustic crosstalk among the ejectors could be suppressed well.

COMPARATIVE EXAMPLE 2

In this comparative example, the plate thickness of the damper member 18 was set at 15 μm, and similar ejection evaluation was performed. In the recording head according to this comparative example, the value $c_p$ was obtained as $c_p=1.6\times10^{-18}$ [$m^5$/N], which was 1.1 times as large as the value $c_n$ and 42 times as large as the value $c_c$. Then, similarly to Comparative Example 1, it was confirmed that no acoustic crosstalk occurred. On the other hand, when the ejectors were driven at the ejection frequency of 20 kHz, the ejection state became unstable even in the case where each ejector was driven independently. The ejection frequency at which stable ejection could be achieved was 13–15 kHz. It was confirmed that this result was also coincident with the analytic result shown in FIG. 15.

COMPARATIVE EXAMPLE 3

Figure 14:
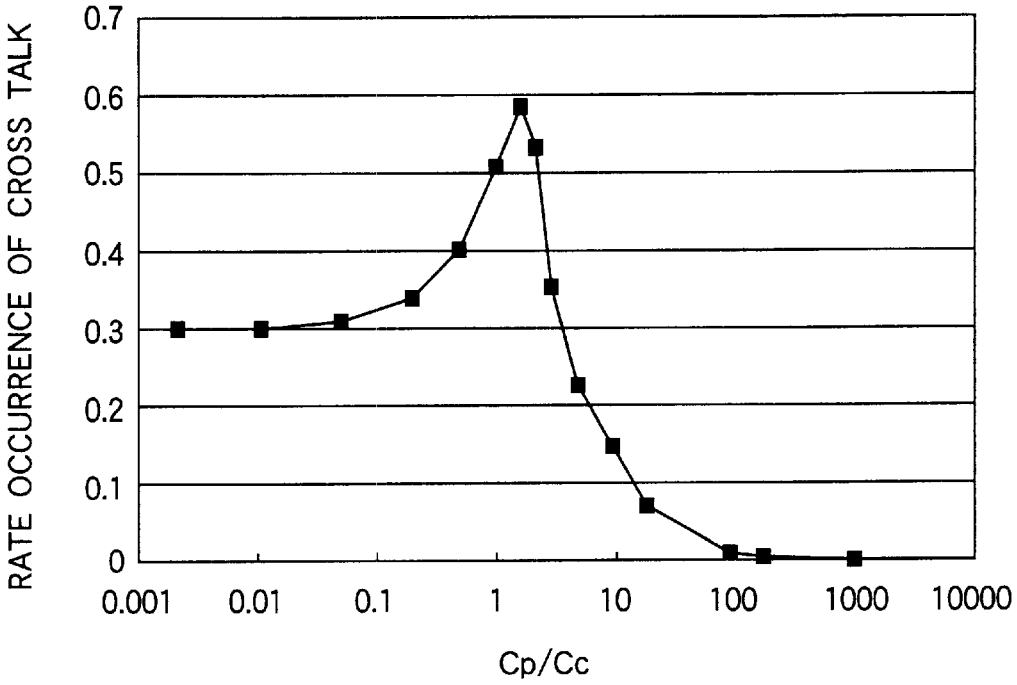
FIG. 14 is a graph for explaining the characteristic required of an ink pool.

In this comparative example, the plate thickness of the damper member 18 was set at 20 μm, and similar ejection evaluation was performed. In the recording head in this comparative example, the value $c_p$ was obtained as $c_p=6.5\times10^{-19}$ [$m^5$/N], which was about 0.4 times as large as the value $c_n$ and 17 times as large as the value $c_c$. In this comparative example, the influence of acoustic crosstalk appeared, and the droplet velocity at the time of concurrent ejection from all the ejectors was 7–8% lower than the droplet velocity at the time when each ejector was driven independently. This result is substantially coincident with the analytic result shown in FIG. 14. On the other hand, the ejection frequency at which ejection was stable at the time of concurrent ejection from all the ejectors was not higher than 13–15 kHz. This result is also coincident with the analytic result shown in FIG. 15. Thus, the effectiveness of the invention could be confirmed.

COMPARATIVE EXAMPLE 4

In this comparative example, the plate thickness of the damper member 18 was set at 30 μm, and similar ejection evaluation was performed. In the recording head in this comparative example, the value $c_p$ was obtained as $c_p=1.9\times 10^{-19}$ [$m^5$/N], which was about 0.13 times as large as the value $c_n$ and 5 times as large as the value $c_c$. In this comparative example, the influence of acoustic crosstalk appeared conspicuously. The droplet velocity at the time of concurrent ejection from all the ejectors was 15–20% lower than the droplet velocity at the time when each ejector was driven independently, and the droplet velocity was not stable. Thus, the ejection state became extremely unstable. It was confirmed that this result was also coincident with the analytic result shown in FIG. 15. In this comparative example, due to the conspicuous occurrence of acoustic crosstalk, the ejection frequency at which ejection was stable could not be obtained.

From the Comparative Examples 1 to 4, it was confirmed that the shortage of ink supply could be suppressed to achieve high speed ink refill if the relationship of the expression (1) was satisfied, and it was also confirmed that acoustic crosstalk could he suppressed if the expression (2) was satisfied. In addition, it was confirmed that when a metal material such as stainless steel was used for the damper member 18 in a matrix array head having narrow branch flow paths 15, the damper member 18 had to be formed to have an extremely thin plate thickness of 7 μm in order to eject large ink droplets of 15 pl continuously and stably at a high ejection frequency of 20 kHz.

Since there are substantially a large number of pinholes in the stainless steel material having a plate thickness of 7 μm, handling of the strength of the stainless steel material in manufacturing is difficult. Even if a head could be manufactured out of a stainless steel material 7 μm thick, the damper member 18 would be broken when external force acts directly on the pressure damper portion due to paper jamming or the like. Thus, it was substantially confirmed that it was extremely difficult to apply the stainless steel material to a matrix array head.

As has been described above, in order to achieve stable ejection at a high ejection frequency and make high density arrangement of ejectors compatible with the stable ejection in a matrix array head having narrow branch flow paths 15, confirmation was made that it was substantially an essential condition that a film-like organic compound whose Young's modulus was one or two digits smaller than that of the metal material was used for the damper member 18. In addition, confirmation could be made that when the wall surfaces of a plurality of branch flow paths 15 on the side of the nozzles 11 were formed of the one-piece film-like damper member 18, a pressure damper mechanism having sufficient capability in each of the branch flow paths 15 could be formed.

Second Embodiment

Figure 7:
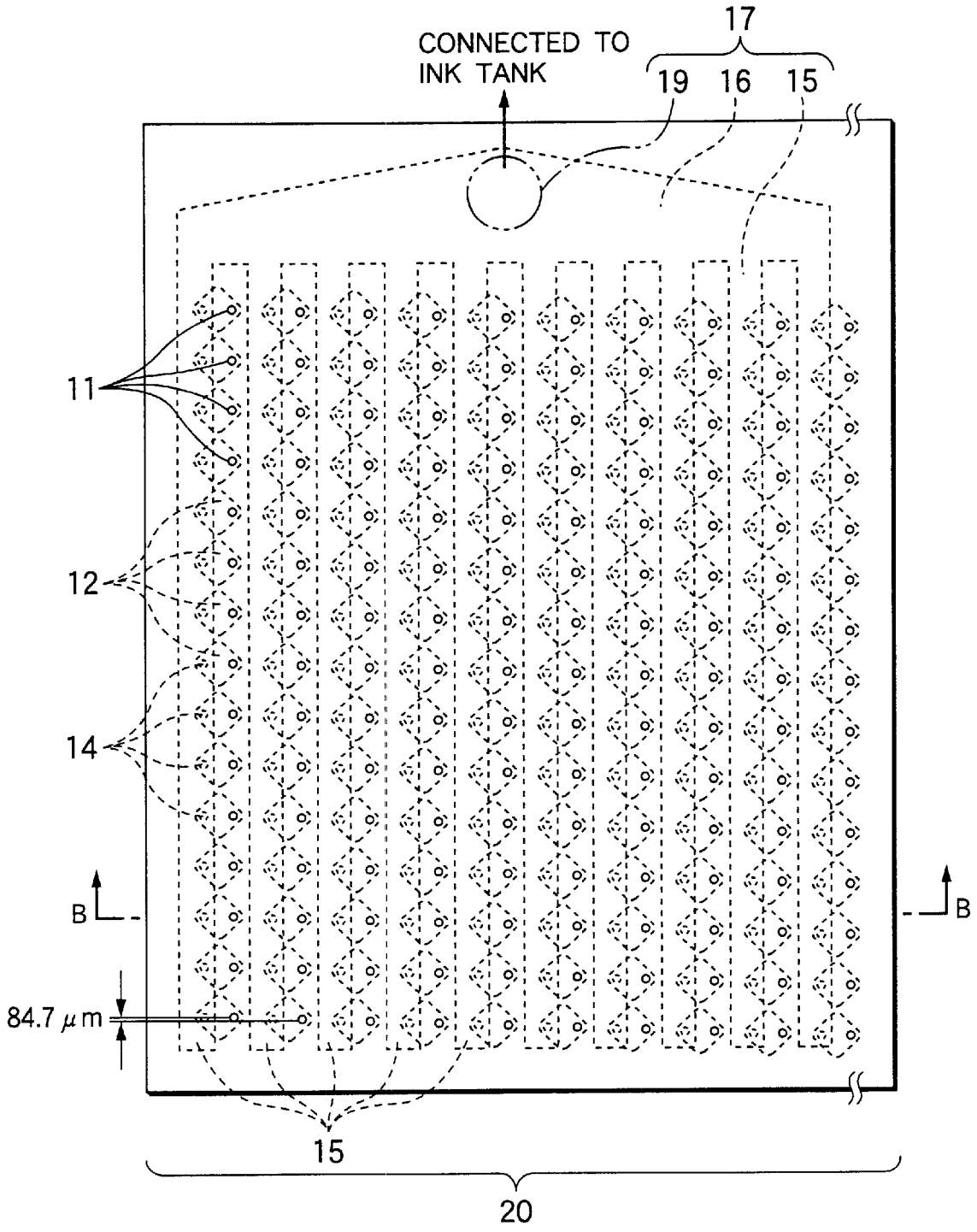
FIG. 7 is a plan view showing an ink jet recording head according to a second embodiment of the invention.
Figure 8:
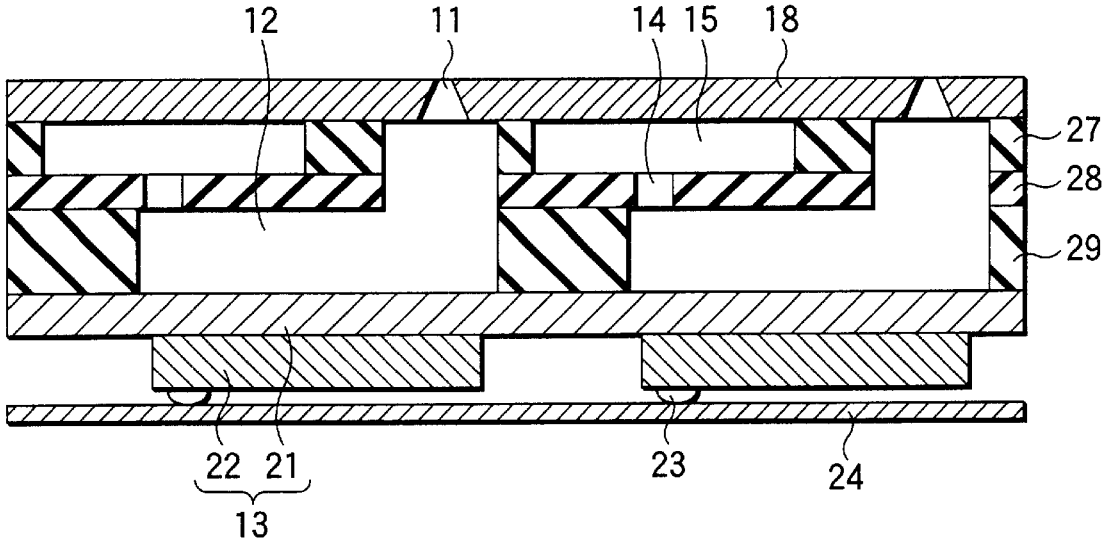
FIG. 8 is a sectional view showing the ink-jet recording head according to the second embodiment.

FIG. 7 is a plan view showing an ink jet recording head according to this, embodiment, and FIG. 8 is a sectional view taken on line B—B in FIG. 7.

As shown in FIG. 7, the recording head according to this embodiment has an ink pool 17 supplied with ink from an external ink tank (not shown) through an ink supply port 19, and a plurality of ejectors arrayed in a matrix. In this embodiment, differently from the first embodiment, a main flow path 16 extends in a straight line in the main-scanning direction at the time of printing, while linear branch flow paths 15 branching from the main flow path 16 in a direction substantially perpendicular thereto extend in the sub-scanning direction.

As shown in FIG. 8, each of the ejectors has a pressure chamber 12, a pressure generating unit 13 and a nozzle 11. The pressure chamber 12 communicates with the corresponding one of the branch flow paths 15 through an inlet 14. The pressure generating unit 13 is constituted by a pressure plate 21 disposed on the bottom surface of the pressure chamber 12, and a single-layer piezoelectric element 22. The nozzle 11 communicates with the pressure chamber 12. The pressure chamber 12 and the branch flow path is are disposed to overlap each other when they are viewed from the nozzle 11 side as shown in FIG. 8.

In the recording head configured thus according to this embodiment, a driving voltage waveform is applied to the piezoelectric elements 22 by a not-shown circuit so that ink droplets are ejected from the nozzles 11 in the same manner as in the first embodiment.

One-side surfaces of the branch flow paths 15 are formed of a damper member 18 disposed on the outer layer surface side of the nozzles 11. The nozzles 11 are formed in the damper member 18. All the plurality of branch flow paths 15 are covered with the damper member 16 which is a one-piece elastic member shared by all the ejectors. Thus, the damper member 18 forms a pressure damper mechanism all over the respective branch flow paths 15. In this embodiment, one surface of the main flow path 16 is also formed on the outer layer surface side of the nozzles 11 in the same manner as the branch flow paths 15. Thus, a pressure damper for the main flow path 16 is formed also on the nozzle outer layer surface side of the main flow path 16 by the damper member 18 provided on the branch flow paths 15.

In this embodiment, as shown in FIG. 7, 15 ejectors communicate with each branch flow path 15, and respective ejectors are disposed so that the pitch of the ejectors in the sub-scanning direction is 300 pieces/inch. In addition, the number of the branch flow paths 15 is set at 10. Thus, one ink jet ejection element 20 for one color is constituted by 150 ejectors in total.

Seven kinds of ink jet recording heads in total are manufactured in which, the width d of each branch flow path is set at 700 μm and the plate thickness of the damper member 18, is set at 12.5 μm, 18 μm, 20 μm, 25 μm, 45 μm, 75 μm and 100 μm, respectively. A polyimide resin film whose Young's modulus is 5 GPa is used as the damper member. The nozzles 11 are formed by excimer laser processing so as to have an aperture diameter of 26 μm. Water-based having ink 3.5 mPa·s in viscosity and 32 mN/m in surface tension is used as the ink.

These recording heads are manufactured as follows. First, as shown in FIG. 8, patterns corresponding to the branch flow paths 15, the inlets 14 and the pressure chambers 12 are formed in a pool plate 27, an inlet plate 28 and a pressure chamber plate 29, respectively, in a wet etching method.

Next, three stainless steel plates in total, that is, the pool plate 27, the inlet plate 28 and the pressure chamber plate 29 are aligned and bonded by use of a thermoplastic adhesive agent. Successively, the damper member 18 made of a polyimide resin film whose surface is coated with an ink repellent treatment agent is bonded with the pool plate 27. Further, the nozzles 11 are formed in the damper member 18 from the side of the pressure chamber plate 29 by excimer laser processing. Successively, the pressure plate 21 is bonded on the side of the pressure chamber plate 29. After that, the piezoelectric elements 22 individualized are fixedly attached just under the pressure chambers 12, respectively by use of a thermosetting adhesive agent. Successively, a flexible print circuit 24 is connected to the piezoelectric elements 22 through the solder bumps 23. Thus, the recording head is completed.

As shown in FIG. 8, such patterns of holes and grooves formed in the pool plate 27, the inlet plate 28 and the pressure chamber plate 29 by etching are four ink jet ejection elements 20*a* to 20*d* as shown in FIG. 3 aligned in the main-scanning direction. In the manufacturing method, a recording head in which heads for four colors are integrated is manufactured.

Here, Table 1 shows acoustic capacitances of the nozzle 11, the pressure chamber 12 and the branch flow path 15 in this second embodiment.

TABLE 1

| thickness [μm] | Cn [$m^5$/N] | Cp [$m^5$/N] | Cp/Cn | Cp/Cc |
|---|---|---|---|---|
| 12.5 | 1.8E−18 | 1.5E−16 | 84.2 | 2690.9 |
| 18 | 1.8E−18 | 5.0E−17 | 28.2 | 900.0 |
| 20 | 1.8E−18 | 3.6E−17 | 20.5 | 656.4 |
| 25 | 1.8E−18 | 1.9E−17 | 10.5 | 336.4 |
| 45 | 1.8E−18 | 3.2E−18 | 1.8 | 57.6 |
| 75 | 1.8E−18 | 6.9E−19 | 0.4 | 12.5 |
| 100 | 1.8E−18 | 2.9E−19 | 0.2 | 5.3 |

From Table 1, it can be understood that the conditions of the expressions (1) and (2), that is, $c_p>10c_n$ and $c_p>20c_c$ can be satisfied simultaneously if the thickness of the damper member 18 is not larger than 25 μm. In addition, as for the suppression of acoustic crosstalk, it is proved that the condition of the expression (2) can be satisfied if the plate thickness of the damper member 18 is not larger than 45 μm.

Figure 9:
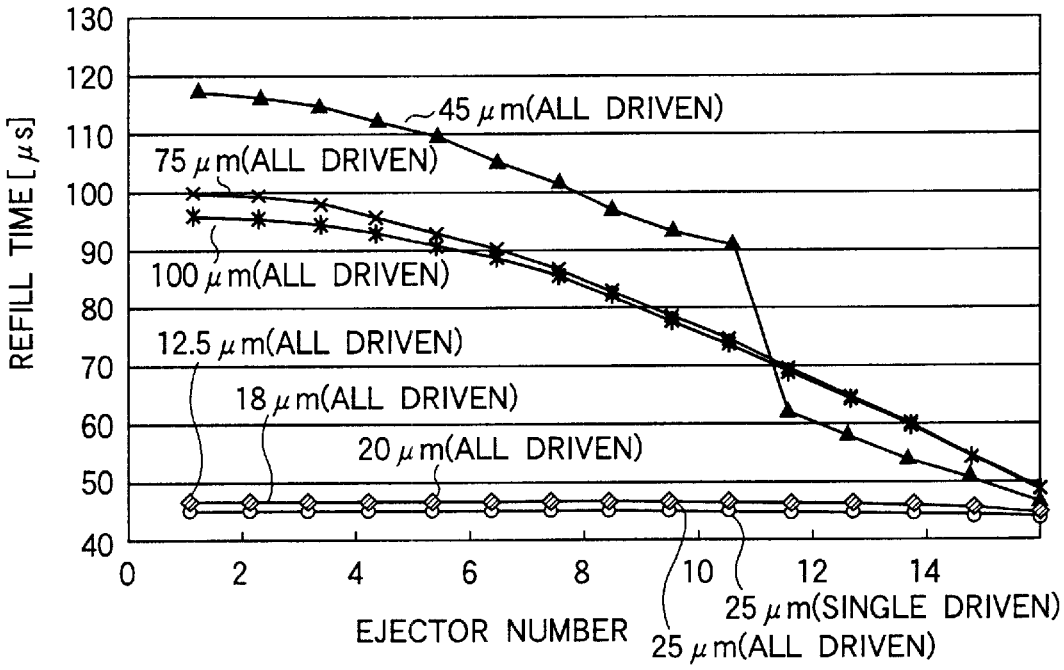
FIG. 9 is a graph showing the ejection characteristic of the ink jet recording head according to the second embodiment.

The result of examination of refill time on the seven kinds of recording heads different in plate thickness of the damper member 18 is shown in the graph of FIG. 9. This graph shows the refill time of 15 ejectors communicating with one branch flow path 15. As shown in the graph, when the plate thickness of the damper member 18 is not larger than 25 μm, the acoustic capacitance of the branch flow path 15 is sufficient so that the refill time is about 45 μs in each of the heads.

As for the recording head in which the plate thickness of the damper member 18 is 25 μm, the graph shows the refill time in the case of independent ejection from a single ejector and the refill time in the case of concurrent ejection from all the ejectors. The refill time (the symbol ♦) in the case of concurrent ejection from all the ejectors and the refill time (the symbol ○) in the case of independent ejection from a single ejector are substantially coincident with each other. Thus, it is confirmed that the difference in refill time among the ejectors in one branch flow path is suppressed well.

Figure 15:
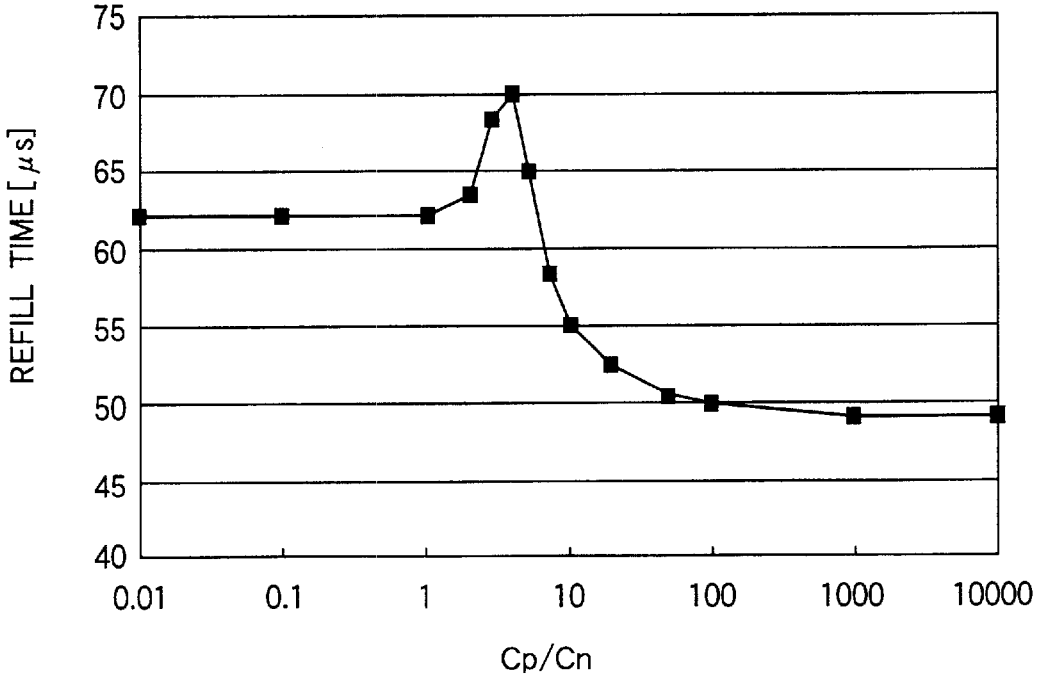
FIG. 15 is another graph for explaining the characteristic required of the ink pool.
Figure 16:
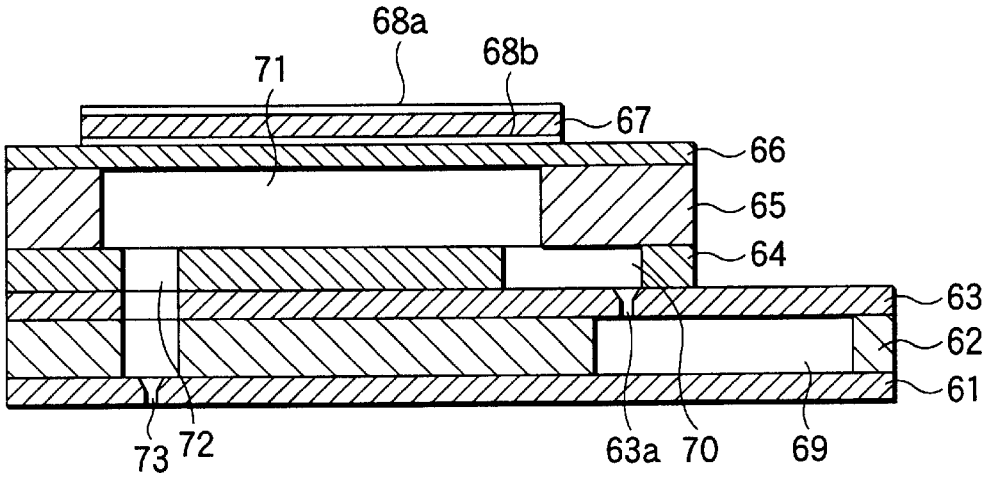
FIG. 16 is a sectional view showing the configuration of a main portion of a related-art ink jet recording head.
Figure 17:
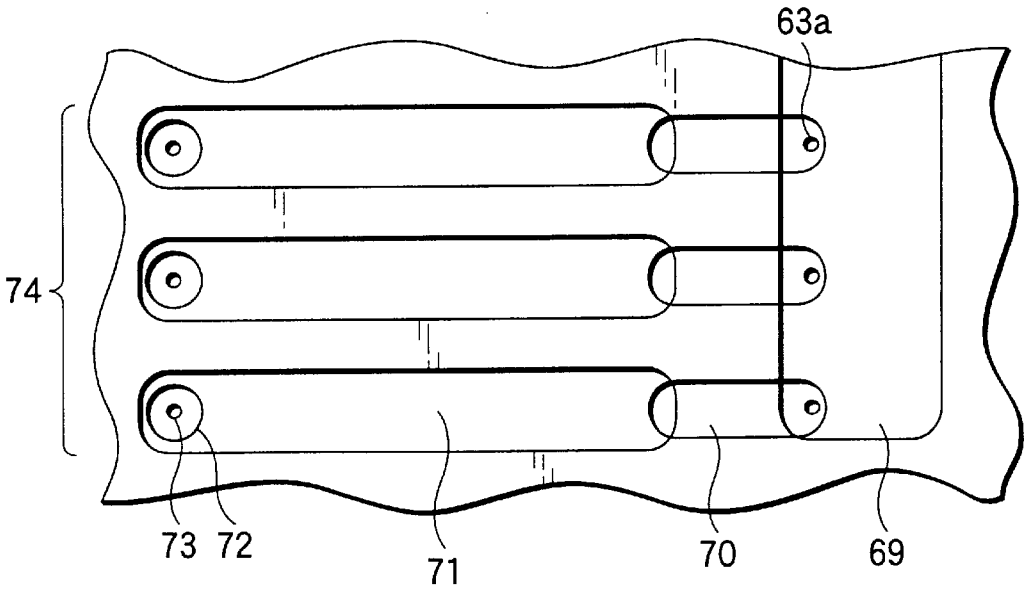
FIG. 17 is a plan view showing the configuration of the main portion in FIG. 16.
Figure 18:
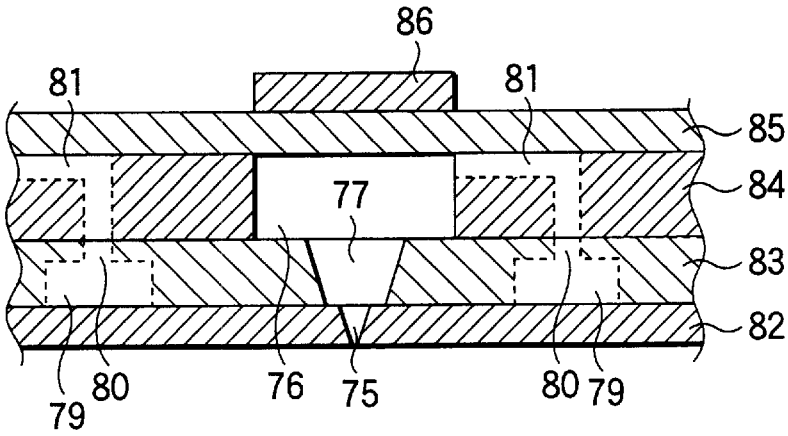
FIG. 18 is a sectional view showing the configuration of a main portion of another related-art inkjet recording head.
Figure 19:
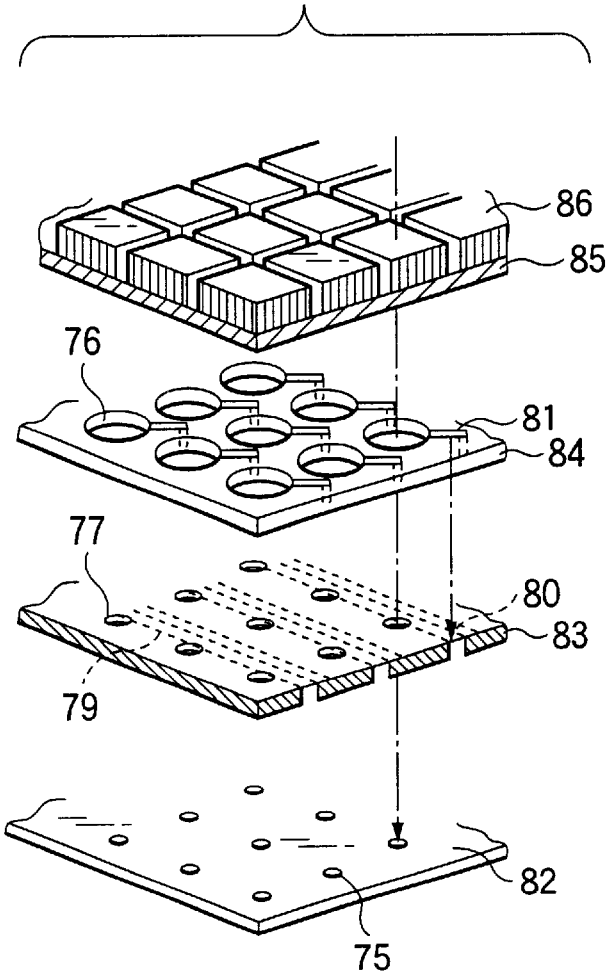
FIG. 19 is a perspective view showing the configuration of the main portion in FIG. 18.
Figure 20A:
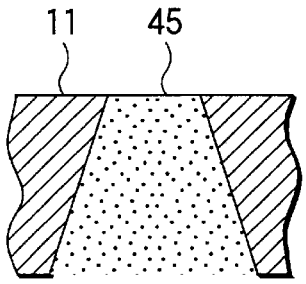
FIGS. 20A to 20F are schematic views for explaining the behavior of a meniscus at the time of refill operation.
Figure 20B:
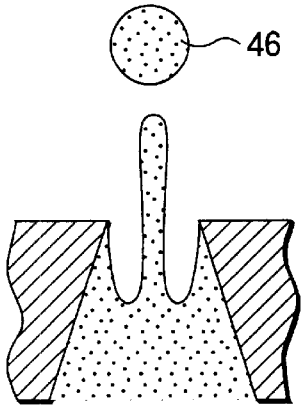
Figure 20C:
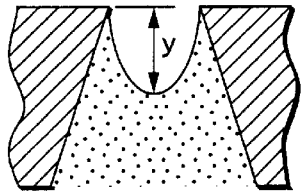
Figure 20D:
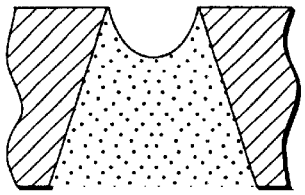
Figure 20E:
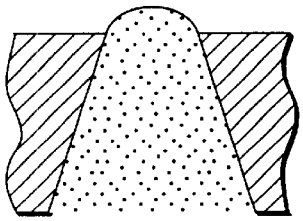
Figure 20F:
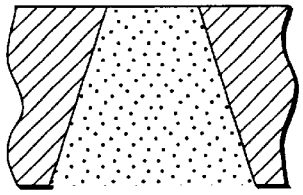
Figure 21:
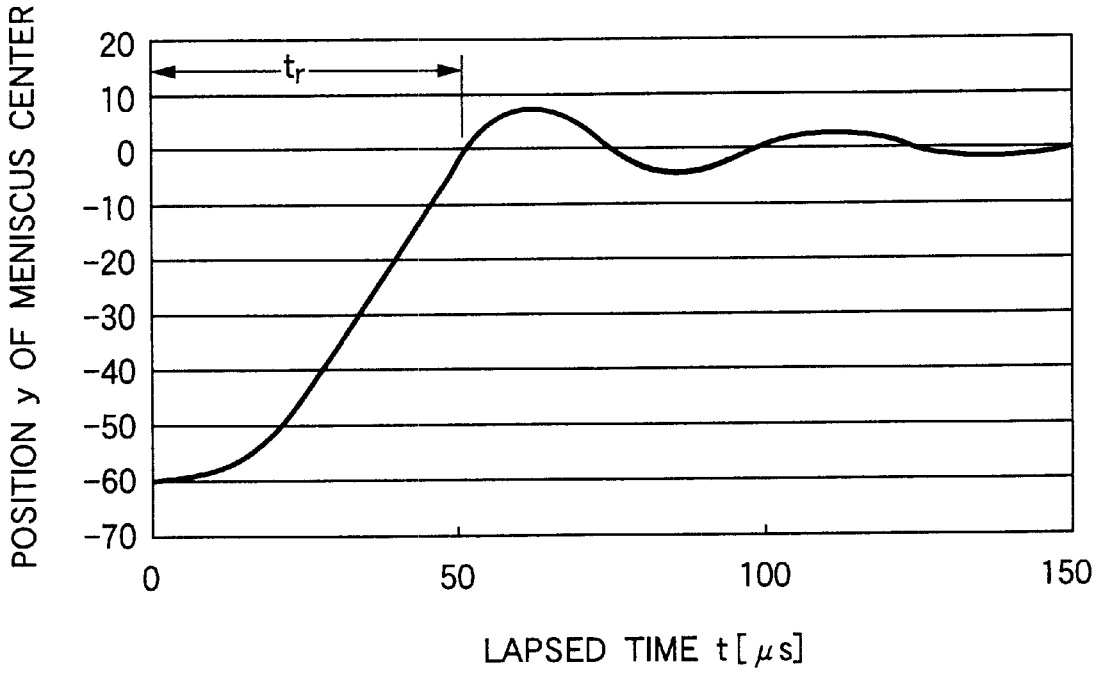
FIG. 21 is a graph for explaining the behavior of the meniscus at the time of refill operation.

On the other hand, when the plate thickness of the damper member 18 is not smaller than 45 μm, it is confirmed that the ink refill time increased suddenly in the case of concurrent ejection from all the ejectors. The average refill times when the plate thickness of the damper member is 45 μm, 75 μm and 100 μm are 90 μs, 81 μs and 79 μs respectively. The reason why the refill time is the longest when the plate thickness of the damper member is 45 μm is considered as follows. That is, as shown in FIG. 15, the pressure wave in the pressure chamber interferes with the pressure wave in the branch flow path because of $c_p/c_n=3.2$. Incidentally, it is proved that there occurs a difference of 50–70 μs in refill time between an ejector close to the main flow path 16 and an ejector in the end of the branch flow path 15 though they are ejectors communicating with the same branch flow path.

By use of the seven kinds of recording heads changed in plate thickness of the damper member 18, ink droplets of 15 pl are ejected concurrently from all the ejectors at a frequency of 20 kHz. As a result, in the heads in which the plate thickness of the damper member 18 is not smaller than 45 μm, ink supply runs short so that ejection becomes unstable to thereby often bring about a result that nozzles can not eject ink droplets. Particularly in the heads in which the plate thickness of the damper member 18 is not smaller than 75 μm, the influence of acoustic crosstalk also appears so that the droplet velocity is made lower at the time of concurrent ejection from all the ejectors than at the time of driving a single ejector independently. In the head in which the plate thickness of the dampermember 18 is 75 μm, the droplet velocity is lowered by about 10%. In the head in which the plate thickness of the damper member 18 is 10 μm, the droplet velocity is lowered by about 20%.

In addition, since the inertance of the nozzles increases with the increase of the plate thickness of the damper member, the ejection efficiency is degraded. Thus, the voltage applied to the piezoelectric elements 22 for ejecting ink droplets of 15 pl increases. The voltage applied to the piezoelectric elements 22 for ejecting ink droplets of 15 pl in the case where the plate thickness of the damper member 18 is 75 μm has to be about twice as high as that in the case where the plate thickness of the damper member 18 is 25 μm. On the other hand, the voltage applied likewise in the case where the plate thickness is 100 μm had to be about 2.5 times as high as that in the case where the plate thickness is 25 μm. It is confirmed that the plate thickness of the damper member had a limit at 100 μm from the point of view of ejection efficiency, and the plate thickness has to be preferably not larger than 75 μm, more preferably not larger than 45 μm.

On the other hand, in the heads in which the plate thickness of the damper member 18 is not larger than 25 μm, the expression (1) and the expression (2) are satisfied simultaneously. It is therefore anticipated that ink droplets of 15 pl can be ejected stably at the frequency of 20 kHz. However, in the heads in which the plate thickness of the damper member 18 is not larger than 18 μm, some nozzles can not eject ink droplets with the progress of continuous ejection. Particularly, in the head in which the damper member 18 is thin to be 12.5 μm, nozzles incapable of ejection occurs conspicuously when ejection is performed continuously. As a result of making investigation into the reason of the incapability of ejection, it is confirmed that bubbles are caught just under the nozzles 11. Here, it is confirmed that the nozzles incapable of ejection can be made capable of ejection again when an ink suction operation which is normally performed in ink jet recording heads is carried out.

As has been described above, it is made clear that in the case where the nozzles 11 are formed in the damper member, bubbles are caught during ejection of ink droplets when the damper member 18 is made extremely thin in order to satisfy the expressions (1) and (2). It is therefore confirmed that the damper member 18 have to be formed to have a plate thickness of at least 20 μm.

Third Embodiment

Figure 10:
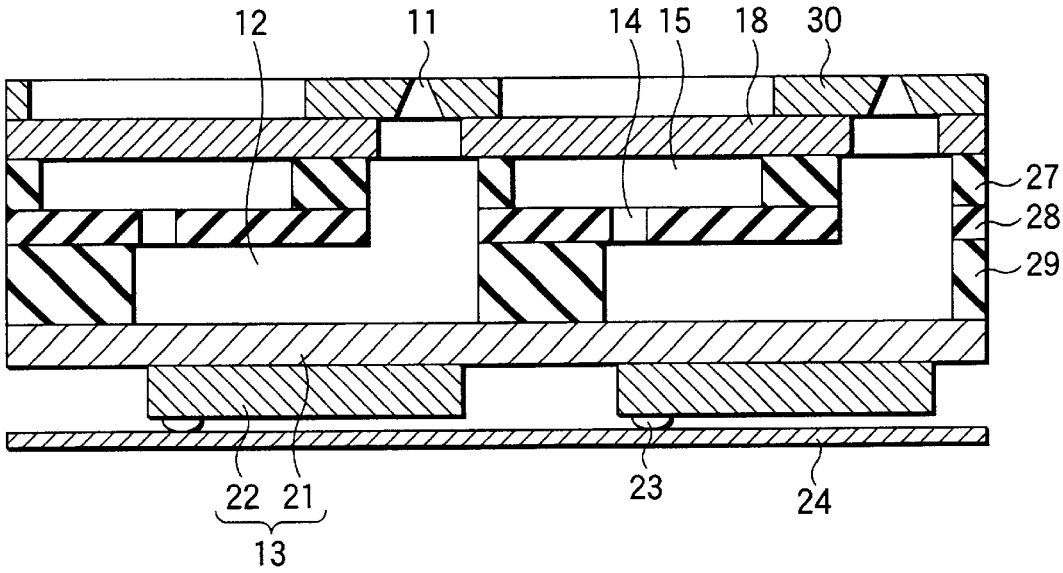
FIG. 10 is a sectional view showing an ink jet recording head according to a third embodiment of the invention.

In this embodiment, the state of the recording head viewed from above is similar to that in FIG. 7 according to the second embodiment. Accordingly, this embodiment will be described with reference to FIG. 7 as its plan view in common. FIG. 10 is a sectional view of this embodiment taken on line B—B in FIG. 7. The recording head according to this embodiment has the same configuration as that according to the second embodiment, except that a nozzle plate 30 is disposed in addition to the damper member 18.

As shown in FIG. 10, one-side surfaces of branch flow paths 15 are formed of a damper member 18 disposed on the outer layer surface side of the nozzles 11. Above the damper member 18, there is provided a nozzle plate bored in positions corresponding to the branch flow paths 15. A plurality of branch flow paths 15 are covered, in a lump, with the damper member 18 made of a one-piece common elastic member. Thus, a pressure damper mechanism is formed on the respective branch flow paths 15. In this embodiment, one surface of a main flow path 16 is also formed on the outer layer surface side of the nozzles 11 in the same manner as the branch flow paths 15. Thus, a pressure damper mechanism for the main flow path 16 is formed also on the nozzle outer layer surface side of the main flow path 16 by the damper member 18 provided on the branch flow paths 15.

In this embodiment, the width $W_d$ of the branch flow path 15 is set at 700 μm, and the plate thickness of the damper member 18 is set at 25 μm. A polyimide resin film whose Young's modulus is 5.7 GPa is used as the damper member 18. Each of the nozzles 11 is formed to be 26 μm in aperture diameter by excimer laser processing. Water-based ink having 3.5 mPa·s in viscosity and 32 mN/m in surface tension is used as the ink.

The acoustic capacitances of the nozzle 11, the pressure chamber 12 and the branch flow path 15 in this embodiment are $9.9\times10^{-19}$ [$m^5$/N], $5.5\times10^{-20}$ [$m^5$/N], and $1.9\times10^{-17}$ [$m^5$/N], respectively. Thus, from $c_p/c_n=18.7$ and $c_p/c_c=336$, it is understood that the conditions of the expressions (1) and (2) are satisfied simultaneously in this embodiment.

By use of the recording head according to this embodiment, the refill time is examined while the number of ejectors ejecting ink droplets concurrently is varied. As a result, the refill time in the case of concurrent ejection from all the ejectors and the refill time in the case of independent ejection from a single ejector are substantially coincident with each other, similarly to the recording head according to the second embodiment. Thus, it is confirmed that the difference in refill time among the ejectors is also suppressed well. In addition, it is confirmed that ink droplets of 15 pl can be ejected from all the ejectors concurrently and stably at an ejection frequency of 20 kHz. Incidentally, an ink repellent material for preventing the ink from adhering is provided near the nozzles 11.

Fourth Embodiment

Figure 11:
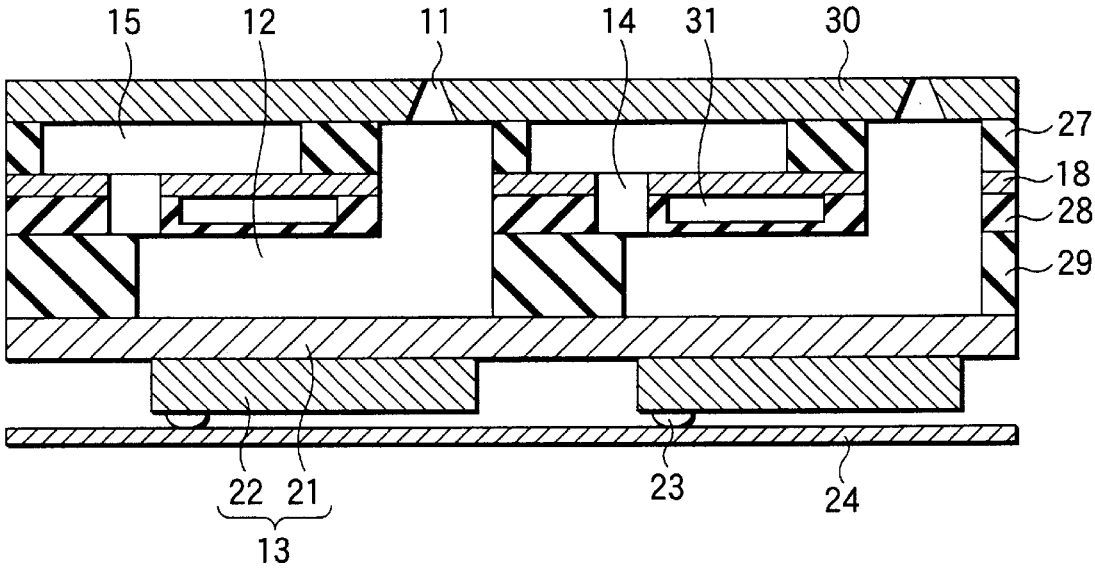
FIG. 11 is a sectional view showing an ink jet recording head according to a fourth embodiment of the invention.

Also in this embodiment, the state of the recording head viewed from above is similar to that in FIG. 7 according to the second embodiment. Accordingly, this embodiment will be described with reference to FIG. 7 as its plan view in common. FIG. 11 is a sectional view of this embodiment taken on line B—B in FIG. 7. The recording head according to this embodiment is different from those according to the second and third embodiments in that a pressure damper mechanism is formed in the inside of the recording head.

As shown in FIG. 11, in the recording head according to this embodiment, the ink passageway from an ink pool to nozzles 11 is obtained by bonding a nozzle plate 30, a pool plate 27, a damper member 18, an inlet plate 28, a pressure chamber plate 29 and a pressure plate 21 with one another so as to put them on top of one another in this order. In the nozzle plate 30, the nozzles 11 are formed. In the pool plate 27, branch flow paths 15 are formed. In the inlet plate 28, recess portions 31 are formed. The nozzles 11 are formed by excimer laser processing so as to have an aperture diameter of ϕ30 μm. The width of each branch flow path 15 is 700 μm, and formed by etching in a stainless steel thin plate.

In the damper member 18, holes forming parts of inlets 14 are formed by excimer laser processing. The damper member is formed of a polyimide resin film which is 5.7 GPa in Young's modulus and 25 μm in thickness. In the inlet plate 28 used in combination with the damper member 18, the recess portions 31 for forming air dampers are formed together with the round holes of the inlets 14 by half etching. Here, the damper member 18 is formed of a one-piece common member. Thus, a pressure damper mechanism is formed for a plurality of branch flow paths 15 in a lump. The other configuration for piezoelectric elements 22, a flexible print circuit 24 and bumps 23 is similar to that in the second and third embodiments.

In the recording head according to this embodiment, the acoustic capacitances of the nozzle 11, the pressure chamber 12 and the branch flow path 15 are $1.8\times10^{-18}$ [$m^5$/N], $5.5\times10^{20}$ [$m^5$/N], and $1.9\times10^{-17}$ [$m^5$/N] respectively. That is, the values $c_p/c_n=10.5$ and $c_p/c_c=336$ satisfy the conditions of the expressions (1) and (2).

By use of the recording head according to this embodiment, the refill time is examined while the number of ejectors ejecting ink droplets concurrently is varied in the same manner as in the second embodiment. As a result, the refill time in the case of independent ejection from a single ejector and the refill time in the case of concurrent ejection from all the ejectors are substantially coincident with each other, in the deviation of ±1 μs. In addition, little acoustic crosstalk occurs. The rate of occurrence of acoustic crosstalk when all the ejectors are driven concurrently is not higher than 1%.

As has been described above, also when a pressure damper mechanism is formed in the inside of the head, it is confirmed that when the expressions (1) and (2) are satisfied, acoustic crosstalk can be prevented, and the shortage of ink supply can be suppressed so that high speed refill can be achieved.

Fifth Embodiment

Figure 12:
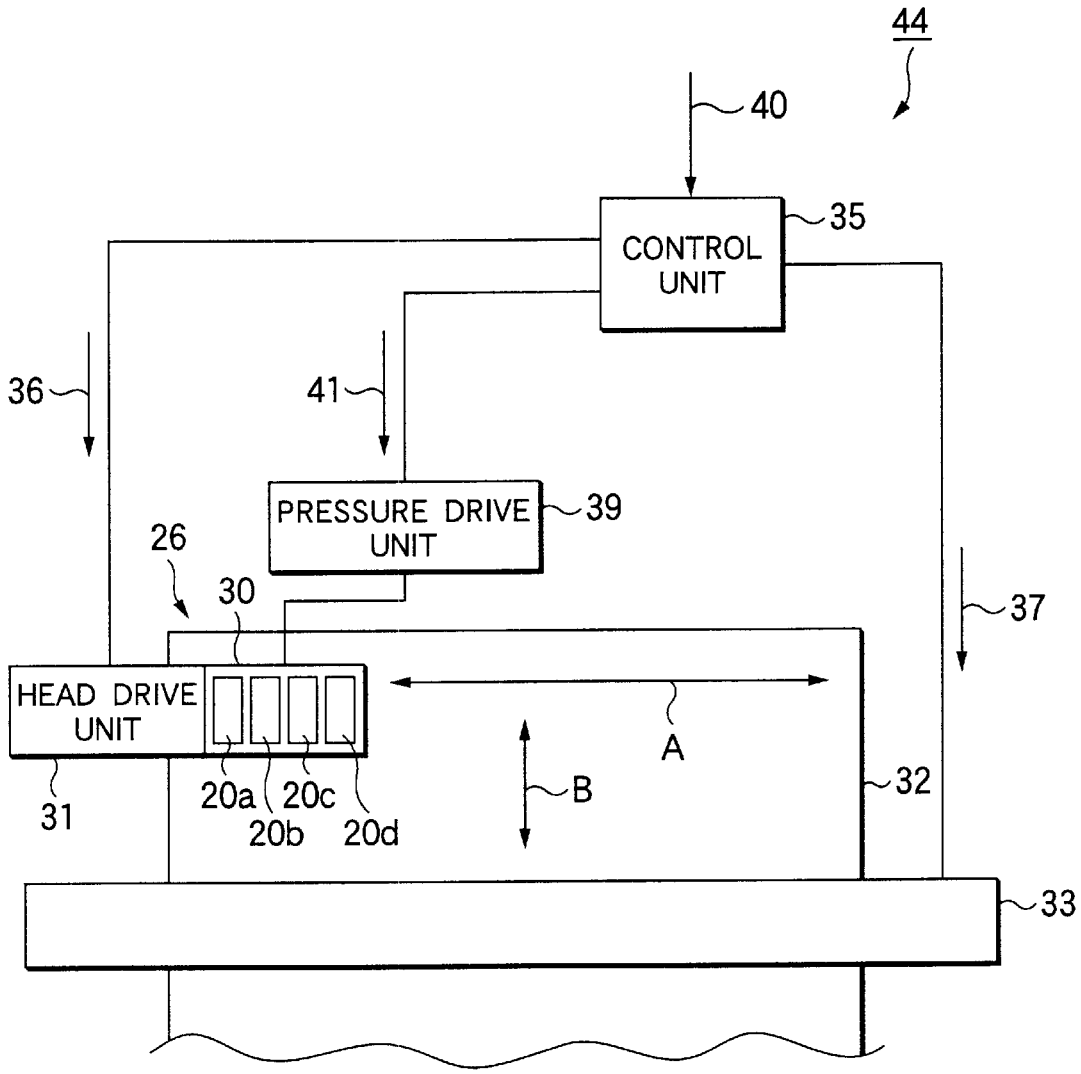
FIG. 12 is a conceptual diagram showing a main portion of an ink jet printer mounted with an ink ejecting head according to the invention.
Figure 13:
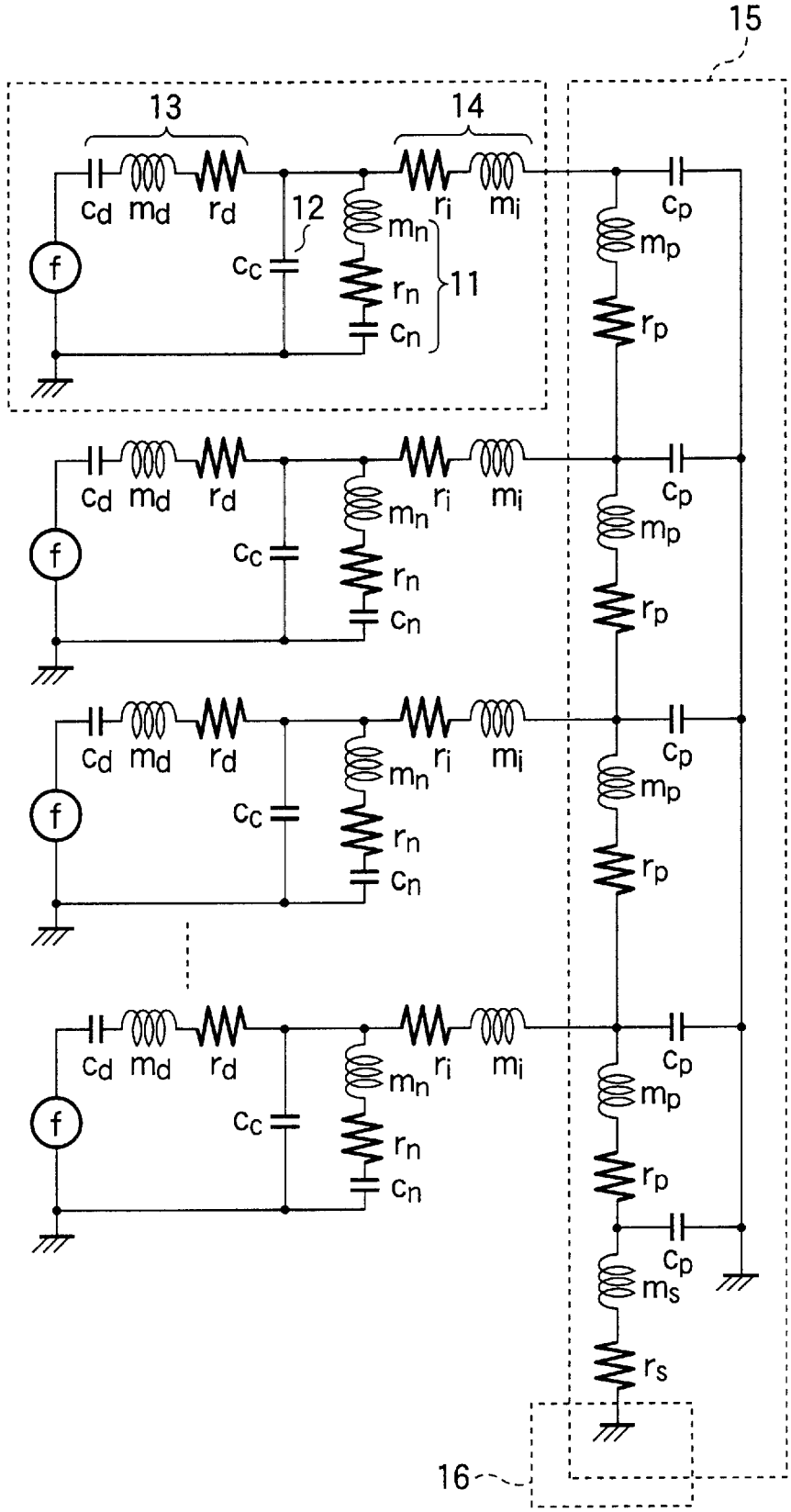
FIG. 13 is a circuit diagram showing an equivalent electric circuit of the ink jet recording heads according to the first to third embodiments.

FIG. 12 is a conceptual diagram showing a main portion of an ink jet printer (ink ejecting apparatus) mounted with an ink jet recording head according to the invention. This ink jet printer 44 has a control unit 35 made of a microcomputer or the like, a pressure drive unit 39, a head drive unit 34, and a paper feeding unit 33 for feeding recording paper 32 while being in contact with the recording paper 32. The ink jet recording head 26 has ink jet ejection elements **20*a* to 20*d* arrayed sequentially in the main-scanning direction shown by the arrow A. The recording paper 32 is brought into contact with the paper feeding unit 33** and conveyed in the sub-scanning direction shown by the arrow B.

The ink jet recording head 26 is moved in the main-scanning direction (A) by the head drive unit 34. The paper feeding unit 33 moves the recording paper 32 in the sub-scanning direction (B) perpendicular to the main-scanning direction (A).

The control unit 35 makes general control over the whole of the ink jet printer 44. In addition, the control unit 35 gives an instruction of the position of the ink jet recording head 26 to the head drive unit 34, and gives an instruction of the position of the recording paper 32 to the paper feeding unit 33. That is, the control unit 35 transmits a pressure control signal 41 to the pressure drive unit 39, a head control signal 36 to the head device unit 34 and a paper feed control signal 37 to the paper feeding unit 33 respectively, converts external signals 40 transmitted from a host system outside the apparatus, into the head control signal 36, the paper feed control signal 37 and the pressure control signal 41, and sends those signals to the head drive unit 34, the paper feeding unit 33 and the pressure drive unit 39 respectively. The pressure control signal 41 includes information as to what time, by how large driving force, how long, which actuator of which unit device should be driven.

In response to the head control signal 36 from the control unit 35, the head drive unit 34 drives the ink jet recording head 26 so as to place the ink jet recording head 26 at specified time and in a predetermined position. In response to the paper feed control signal 37 transmitted from the control unit 35, the paper feeding unit 33 drives the recording paper 32 so as to place the recording paper 32 at specified time and in a predetermined position. Electric signals, optical signals or radio signals may be used as the external signal 40, the head control signal 36, the paper feed control signal 37 and the pressure control signal 41.

Each piezoelectric element in the ink jet ejection elements 20*a* to 20*d* of the ink jet recording head 26 is actuated in response to the pressure control signal 41 received through the pressure drive unit 39, so as to apply pressure to the ink in its corresponding pressure chamber 12, and eject the ink from the nozzle communicating with this pressure chamber 12. In such a manner, the position of the ink jet recording head 26, the position of the recording paper 32 and the application of the pressure control signal 41 are synchronized with one another. Thus, an image, a character or the like can be expressed in a desired position within a printing range of the recording paper 32, and in a color tone with desired color and desired contrast.

When the invention is applied thus, a matrix array head having nozzles arrayed in high density can be realized. Thus, it is possible to realize an ink jet recording head having ink jet recording heads such as ink jet ejection elements 20*a* to 20*d* having a larger number of nozzles and smaller dimensions in comparison with those in the related art in order to perform printing at a high speed, and it is possible to realize a small-size ink ejecting apparatus such as a small-size ink jet printer mounted with the ink jet recording head.

Sixth Embodiment

This embodiment is an embodiment using ink containing an organic EL device material as the ink to be ejected. In this embodiment, an organic EL display substrate is used as a subject to eject and apply the ink thereon. Thus, by use of an ink jet recording head according to the invention, it is possible to arrange an organic EL display manufacturing device, an organic EL display manufacturing head, and an organic EL display manufacturing apparatus.

The organic EL display substrate has an upper electrode and a lower electrode in its front and rear surfaces respectively. For example, when organic materials such as PEDT polyaniline are used as the material the lower electrode, ink in which those materials have been dissolved is used. The ink in which PEDT polyaniline has been dissolved is ejected onto a transparent substrate by the organic EL display manufacturing apparatus so that a pattern can be formed.

In addition, other examples of materials that can be ejected and applied to form a pattern by this ink ejecting apparatus may include an electron injection layer material, an electron transport layer material, a light emitting layer material, a positive hole transport layer material, a positive hole injection layer material and an upper electrode layer material. Such materials for the three primary colors are ejected and applied so that it is possible to manufacture an organic display which can display in color.

Seventh Embodiment

This embodiment is an embodiment using ink containing an organic semiconductor material as the ink to be ejected. In this embodiment, an organic semiconductor device substrate is used as a subject to eject and apply the ink thereon. Thus, by use of an ink jet recording head according to the invention, it is possible to arrange an organic semiconductor device manufacturing device, an organic semiconductor device manufacturing head, and an organic semiconductor device manufacturing apparatus. In this case, a source electrode and a drain electrode are formed on an organic semiconductor device substrate in advance. The ink containing an organic semiconductor is ejected by this ink ejecting apparatus so as to be laid between the source electrode and the drain electrode. Further, after the ink is solidified, a gate electrode pattern is formed between the source electrode and the drain electrode.

In addition, an insulating layer is formed on an organic semiconductor layer, and a gate electrode is formed on this insulating layer. Alternatively, a gate electrode is formed on an organic semiconductor device substrate, and an insulating layer is formed on this gate electrode. A source electrode pattern and a drain electrode pattern are formed on this insulating layer. Further, on these patterns, an organic semiconductor layer is formed by use of the ink jet recording head. When organic materials are used for the respective electrodes and the insulating layer, a solution containing an organic semiconductor material may be ejected and applied by this ink jet recording head so as to be formed into a pattern.

As the organic semiconductor material, pentacene, regioregular poly(3-hexylliophene), or the like, may be used. In addition, as the organic electrode material, high doped polyaniline, PEDOT, or the like, may be used. As the insulating material, various materials maybe used if they have process compatibility.

Incidentally, although polyimide resin was used for a damper member in each of the first to fourth embodiments of the invention, not to say, similar effect can be obtained by any film-like organic compound material.

The invention has been described above on the basis of its preferred embodiments. However, the ink jet recording head and the ink jet recording apparatus according to the invention are not limited to the configurations of the embodiments. Various modifications and alterations can be performed on the configurations of the embodiments. Any ink jet recording head and any ink jet recording apparatus obtained by such modification and alternation are also included in the scope of the invention.

As has been described above, according to the invention, it is possible to obtain an ink jet recording head in which a high-density nozzle array is realized in a matrix array head, while a sufficient acoustic capacitance is secured in a plurality of branch flow paths in a simple configuration and at low cost so that acoustic crosstalk can be suppressed, the shortage of ink supply can be prevented, and high-speed ink refill operation can be achieved, and it is possible to obtain an ink jet recording apparatus having such an ink jet recording head.

What is claimed is:

1. An ink jet recording head comprising:

an ink supply port;

a flow path to which ink is supplied from outside through the ink supply port;

a plurality of ejectors communicating with the flowpath, respectively, each of the plurality of ejectors including: a pressure chamber communicating with the flow path;

a pressure generating unit for generating a pressure wave in ink charged into the pressure chamber; and a nozzle for ejecting the ink from the pressure chamber due to the pressure wave;

a nozzle plate in which the nozzles are formed; and a damper member covering the flow path for suppressing crosstalk occurring among the plurality of pressure chambers or for preventing shortage of ink supply to the pressure chamber, wherein the nozzle plate is used as the damper member.

2. The ink jet recording head according to claim 1, wherein the damper member satisfies:

$$c_p > 10c_n$$

where $c_p$ designates an acoustic capacitance of the flow path per ejector and $c_n$ designates an acoustic capacitance of the nozzle.

3. The ink jet recording head according to claim 1, wherein the damper member satisfies:

$$c_p > 20c_c$$

where $c_p$ designates an acoustic capacitance of the flow path per ejector and $c_c$ designates an acoustic capacitance of the pressure chamber.

4. The ink jet recording head according to claim 1, wherein thickness of the nozzle plate is not smaller than 20 $\mu$m and not larger than 100 $\mu$m.

5. The ink jet recording head according to claim 1, wherein the damper member is made of a film-like organic compound.

6. The ink jet recording head according to claim 5, wherein the organic compound includes one selected from the group consisting of acrylic resin, aramid resin, polyimide resin, aromatic-polyamide resin, polyester resin, polystyrene resin, nylon resin, and polyethylene resin.

7. The ink jet recording head according to claim 1, wherein the plurality of ejectors are arrayed in a M*N matrix; and wherein the flow path has:

a main flow path communicating with the ink supply port; and

M branch flow paths branching from the main flow path; and wherein N ejectors communicate with each of the branch flow paths adjacently to one another.

8. The ink jet recording head according to claim 7, wherein the pressure generating unit includes:

a piezoelectric element; and a pressure plate for transmitting displacement of the piezoelectric element to the ink in the pressure chamber; and wherein a maximum droplet quantity, which the pressure generating unit can eject, is not smaller than 15 pl.

9. The ink jet recording head according to claim 8, wherein the pressure generating unit having the piezoelectric element and pressure plate is constituted by a piezoelectric actuator in which the pressure plate is flexibly deformed in accordance with expansion and contraction deformation of the piezoelectric element.

10. The ink jet recording head according to claim 1, wherein the ink contains an organic EL device material.

11. The ink jet recording head according to claim 1, wherein the ink contains an organic semiconductor material.

* * * * *